US009494008B2

(12) United States Patent
Pacey

(10) Patent No.: US 9,494,008 B2
(45) Date of Patent: Nov. 15, 2016

(54) SEGMENTED SEAT FOR WELLBORE SERVICING SYSTEM

(71) Applicant: Halliburton Energy Services, Inc., Houston, TX (US)

(72) Inventor: Kendall Lee Pacey, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/788,225

(22) Filed: Jun. 30, 2015

(65) Prior Publication Data

US 2015/0300120 A1 Oct. 22, 2015

Related U.S. Application Data

(63) Continuation of application No. 13/414,989, filed on Mar. 8, 2012, now Pat. No. 9,103,189.

(51) Int. Cl.

| | |
|---|---|
| ***E21B 34/10*** | (2006.01) |
| ***E21B 33/12*** | (2006.01) |
| ***E21B 34/12*** | (2006.01) |
| ***E21B 41/00*** | (2006.01) |
| ***E21B 34/14*** | (2006.01) |
| ***E21B 43/14*** | (2006.01) |
| *E21B 34/00* | (2006.01) |

(52) U.S. Cl.

CPC ..... *E21B 33/12* (2013.01); *E21B 34/10* (2013.01); *E21B 34/12* (2013.01); *E21B 34/14* (2013.01); *E21B 41/00* (2013.01); *E21B 43/14* (2013.01); *E21B 2034/007* (2013.01)

(58) Field of Classification Search

CPC ..... E21B 34/14; E21B 34/06; E21B 34/08; E21B 33/12

USPC ..... 166/334.1, 373, 381, 386, 319

See application file for complete search history.

(56) References Cited

U.S. PATENT DOCUMENTS

| | | | | |
|---|---|---|---|---|
| 4,098,335 A * | 7/1978 | Goad | E21B 23/06 166/120 |
| 5,960,881 A * | 10/1999 | Allamon | E21B 21/103 166/285 |
| 2009/0159289 A1* | 6/2009 | Avant | E21B 34/14 166/316 |

(Continued)

OTHER PUBLICATIONS

First Office Action issued by the Canadian Patent Office regarding co-pending Canadian Patent Application No. 2,859,095, dated Oct. 2, 2015, 4 pages.

Patent Examination Report issued by IP Australia regarding co-pending Australian Patent Application No. 2013230595, dated Jul. 1, 2015, 3 pages.

Communication pursuant to Rules 161 (1) and 162 EPC, dated Oct. 17, 2014, regarding European Patent Application No. 13710643.1.

International Search Report and Written Opinion dated Apr. 4, 2014 for Application No. PCT/US2013/026941.

*Primary Examiner* — Kenneth L Thompson
*Assistant Examiner* — David Carroll
(74) *Attorney, Agent, or Firm* — Haynes and Boone, LLP

(57) ABSTRACT

A segmented seat adapted to be placed in subterranean wellbore equipment and engaged by an obturator. The segmented seat includes an annular body that is radially divided into a plurality of separate segments, the annular body defining a central bore extending axially therethrough, a generally cylindrical outer wall, and an end wall; an annular seat formed on the end wall and extending about the central bore of the annular body, the annular seat being of a size and shape to engage the obturator; at least one recess formed into each of the segments and offset from the outer wall of the annular body so that at least a portion of the annular body is located radially between the outer wall and the recess; and a non-metallic material disposed within the recess and joining adjacent segments together.

39 Claims, 15 Drawing Sheets

(56) References Cited

U.S. PATENT DOCUMENTS

2011/0036590 A1* 2/2011 Williamson ..... E21B 21/103 166/373
2011/0192607 A1* 8/2011 Hofman ..... E21B 34/14 166/317
2011/0253383 A1 10/2011 Porter et al.
2011/0315390 A1 12/2011 Guillory et al.
2012/0205120 A1* 8/2012 Howell ..... E21B 34/108 166/373
2012/0205121 A1 8/2012 Porter et al.
2012/0227973 A1 9/2012 Hart et al.
2012/0305236 A1* 12/2012 Gouthaman ..... E21B 33/1285 166/118

* cited by examiner

FIG.2C
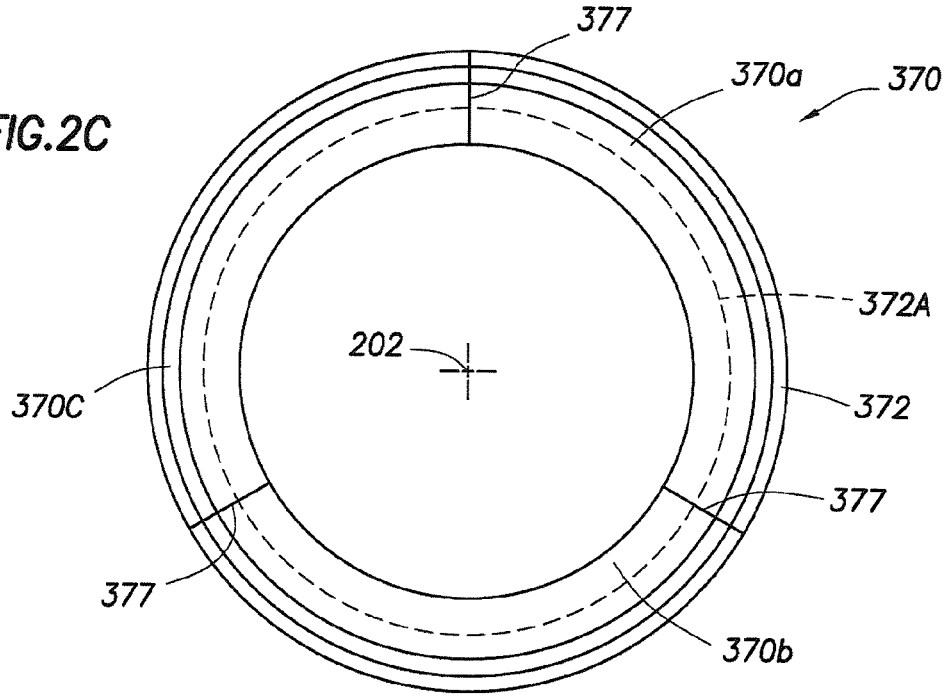
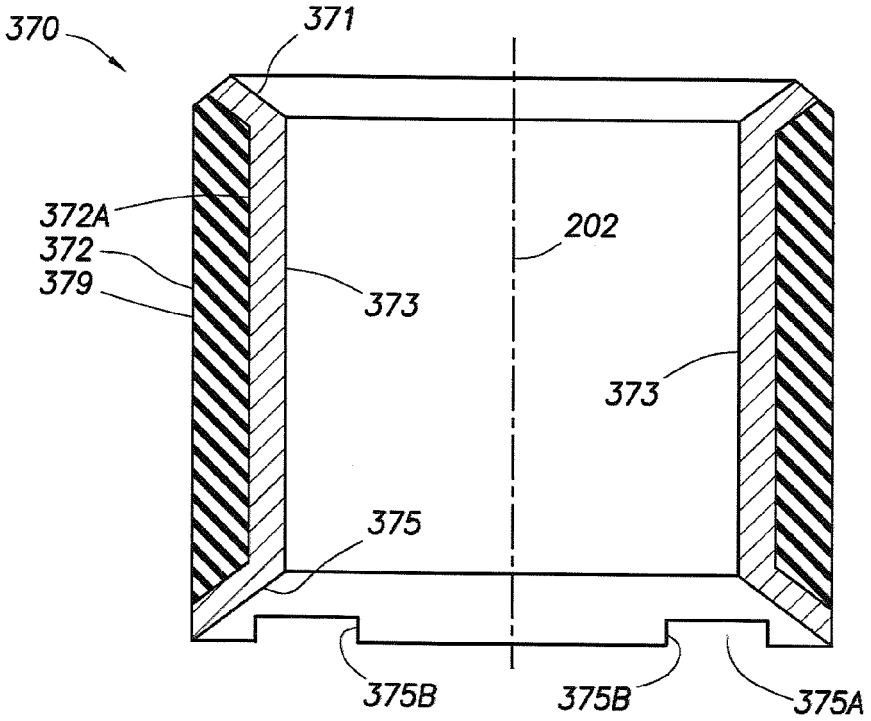
FIG.2D

FIG.2E
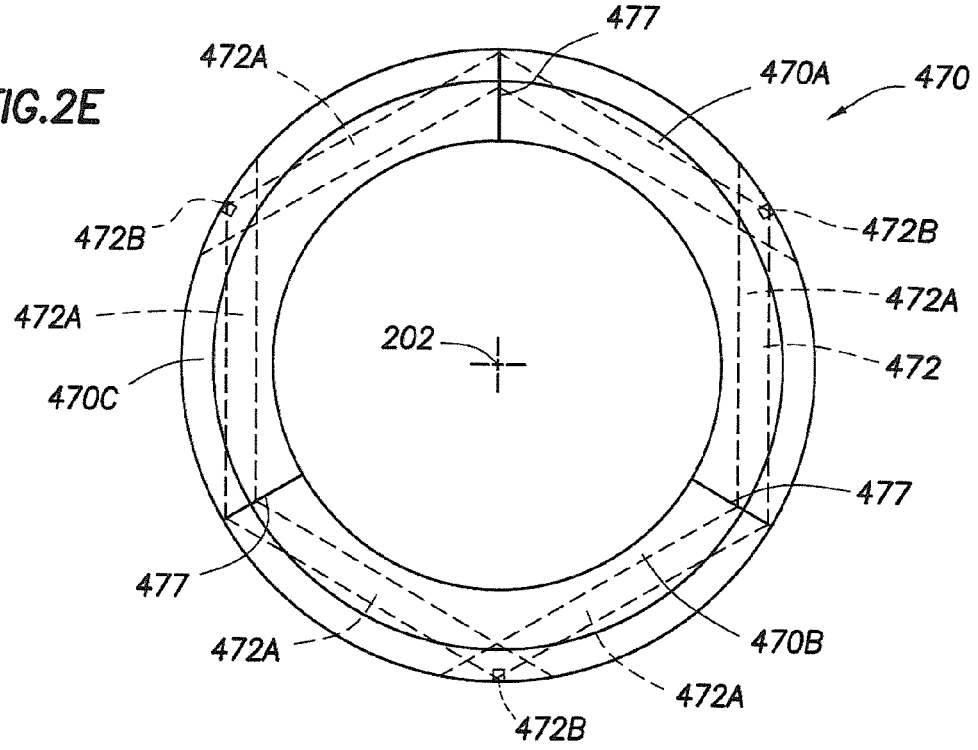
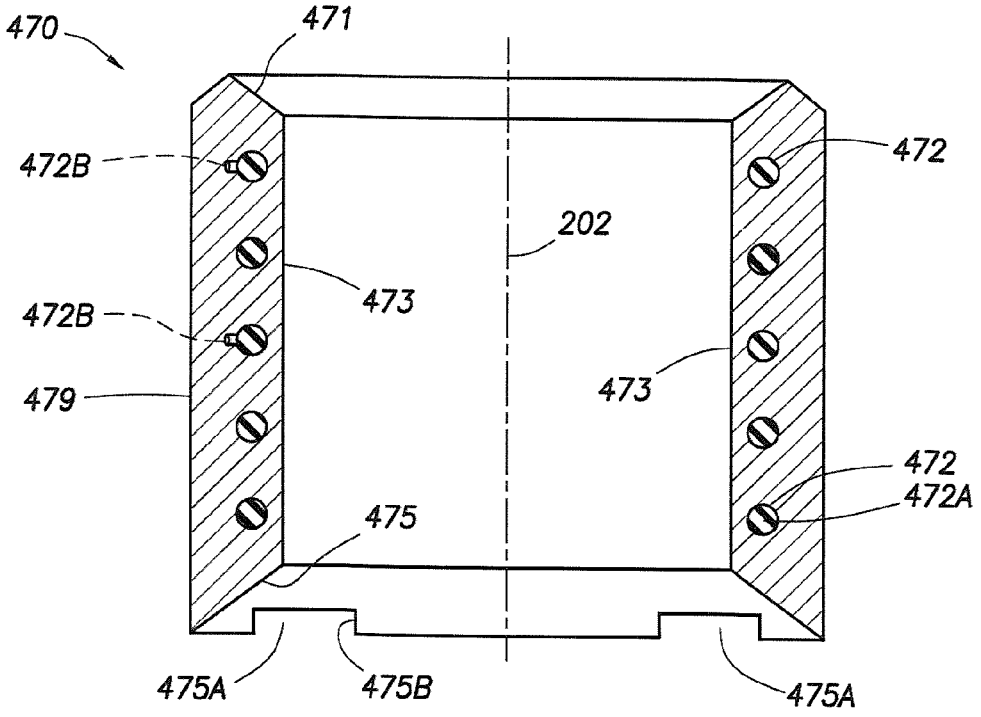
FIG.2F

FIG.2I
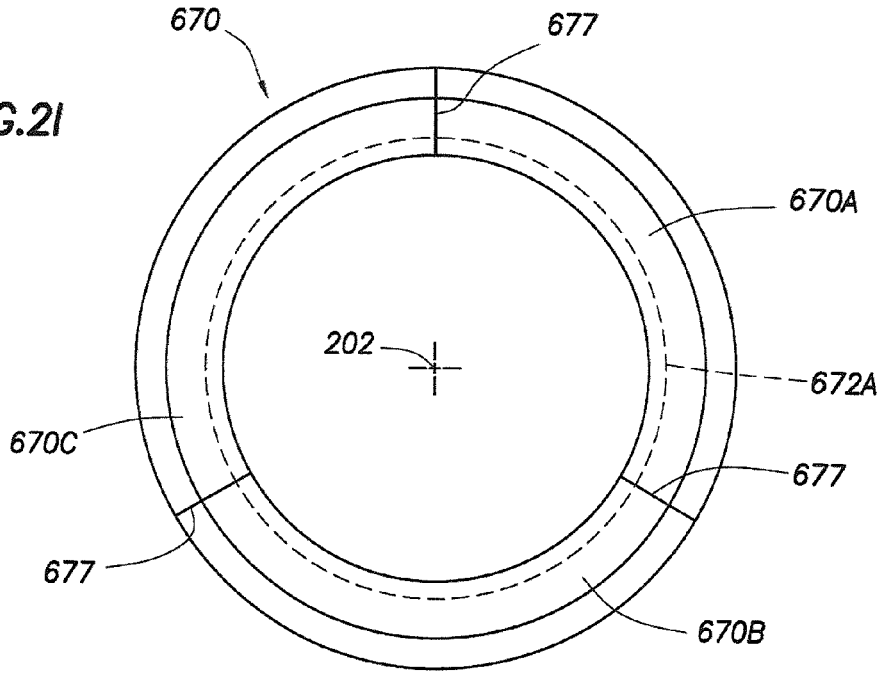
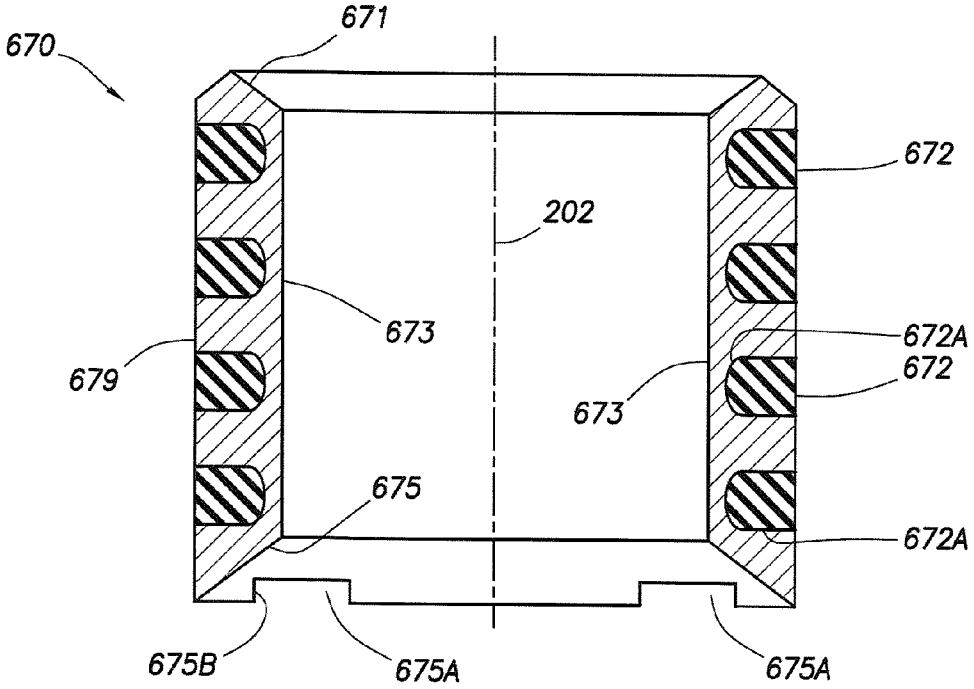
FIG.2J

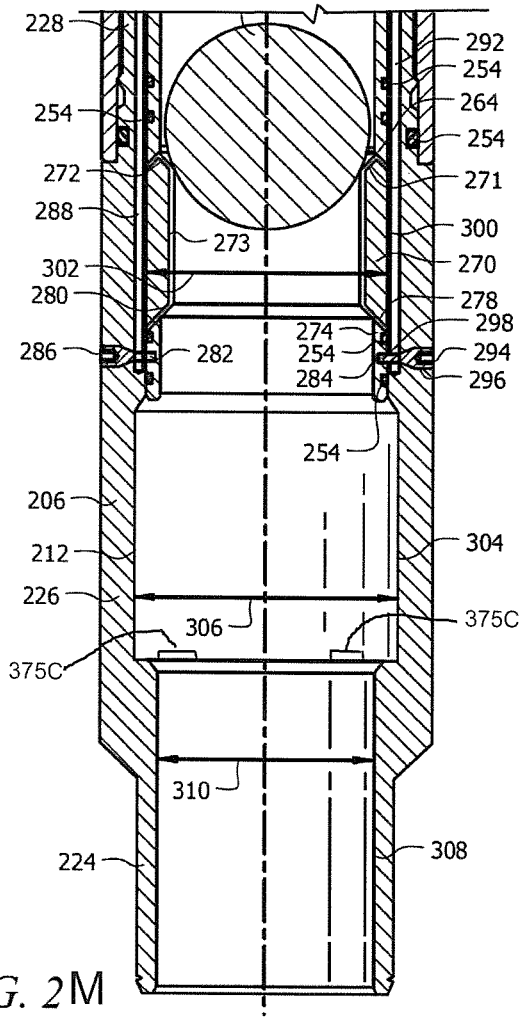
*FIG. 2*M

SEGMENTED SEAT FOR WELLBORE SERVICING SYSTEM

CROSS-REFERENCE TO RELATED APPLICATIONS

This application is a continuation of U.S. patent application Ser. No. 13/414,989, filed Mar. 8, 2012, the entire disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

It is common to utilize equipment with flow restrictors, valve seats or baffles at the subterranean locations in a wellbore to temporarily restrict or block flow. For example, well formations that contain hydrocarbons are sometimes non-homogeneous in their composition along the length of wellbores that extend into such formations. It is sometimes desirable to treat and/or otherwise manage the formation and/or the wellbore differently in response to the differing formation composition. Some wellbore servicing systems and methods allow such treatment, referred to by some as zonal isolation treatments. In these systems zones can be treated separately.

In obturator actuated systems, an obturator is transported down the wellbore to engage a downhole well tool. The terms, "up", "upward", "down" and "downward", when used to refer to the direction in the well bore without regard to the orientation of the well bore. Up, upward and up hole refer to the direction toward the well head. Down, downward, and downhole refer to a direction away from the well head. In these systems, each downhole well tool typically includes a rigid metallic seat to seal against the obturator and activate the tool. In many situations after actuation, the seat and other components are removed by drilling operations. As used herein, the terms "drilling" refers to contacting with an object to break it into smaller pieces with a moving tool, such as a drill bit or milling tool. Accordingly, there exists a need for improved systems and methods of treating multiple zones of a wellbore with drillable seats.

SUMMARY

Disclosed herein are segmented seats for use in wellbore servicing systems which can be utilized in downhole environments with obturators and valve elements to perform tasks downhole, such as, shift sleeves, open ports, block and/or restrict flow and the like. In the disclosed example the segmented seats are used to shift sleeves to open side ports to selectively actuate downhole equipment to treat multiple zones.

The segmented seats are installed in a central bore of the sleeve system, wherein the sleeve defines a central passageway and is mounted in a axially shiftable sleeve associated with a side port. A corresponding sized obturator (ball or dart) is dropped of flowed into contact with the seat. While the obturator blocks the central passageway in the seat pressure is raised and the sleeve is shifted to either open or close the side port. There after the segmented seat is allow to shift down through the sleeve to an enlarged bore where the sleeve segments separate radially allowing the obturator to pass through to central passageway of the seat. When it is necessary to remove the seat as an obstruction in the wellbore, drilling or milling operations are enhanced due to the segmented configuration of the seat.

Additionally disclosed herein is an annular seat with a central port with and obturator engaging concave seat surrounding the port. The structural portion of the seat is divided into segments with each segment having one or more recesses or chambers containing non-metallic material. At least one of the recesses or chambers extends continuously through each seat segment to form an alular structure to hold the seat segments together during installation and initial use.

BRIEF DESCRIPTION OF THE DRAWINGS

For a more complete understanding of the present disclosure and the advantages thereof, reference is now made to the following brief description, taken in connection with the accompanying drawings and detailed description:

FIG. 2C is a top plan view of first alternative embodiment of the segmented seat of the sleeve system of FIG. 2;

FIG. 2D is a cross-sectional view of the segmented seat embodiment of FIG. 2C;

FIG. 2E is a top plan view of second alternative embodiment of the segmented seat of the sleeve system of FIG. 2;

FIG. 2F is a cross-sectional view of the segmented seat embodiment of FIG. 2E;

FIG. 2I is a top plan view of forth alternative embodiment of the segmented seat of the sleeve system of FIG. 2;

FIG. 2J is a cross-sectional view of the segmented seat embodiment of FIG. 2I;

FIG. 2M is a cross-sectional view of the catch bore with the upward facing protrusions;

DETAILED DESCRIPTION OF THE EMBODIMENTS

Figure 1:
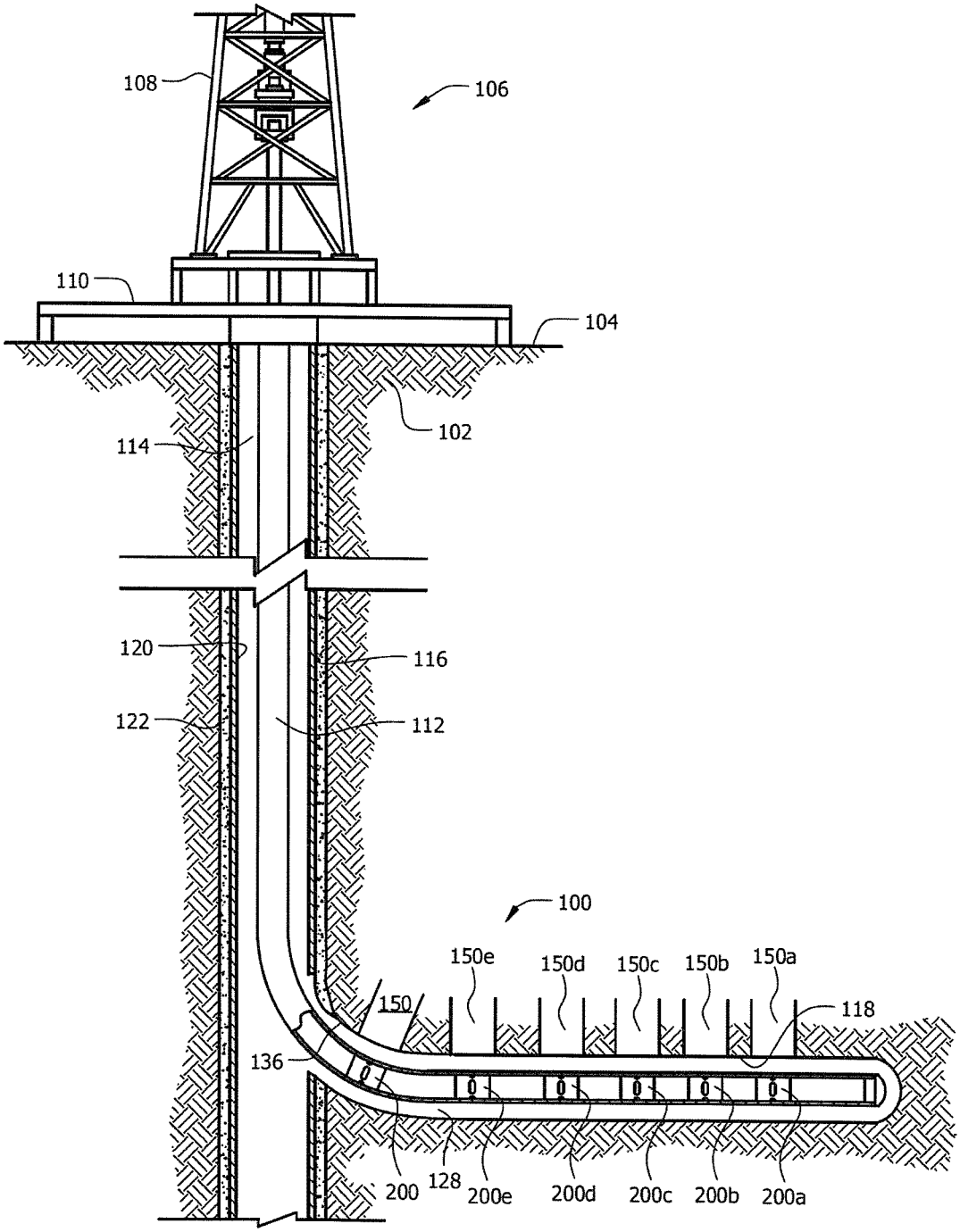
FIG. 1 is a cut-away view of an embodiment of a wellbore servicing system according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ." Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments and by referring to the accompanying drawings.

Disclosed herein are improved components, more specifically, an improved segmented seat with enhance drill-out characteristics, for use in downhole tools. Such a segmented seat may be employed alone or in combination with other components.

Also disclosed herein are sleeve systems and methods of using downhole tools, more specifically sleeve systems employing the segmented seat that may be placed in a wellbore in a "run-in" configuration or an "installation mode" where a sleeve of the sleeve system blocks fluid transfer between a flow bore of the sleeve system and a port of the sleeve system. The installation mode may also be referred to as a "locked mode" since the sleeve is selectively locked in position relative to the port. In some embodiments, the locked positional relationship between the sleeves and the ports may be selectively discontinued or disabled by unlocking one or more components relative to each other, thereby potentially allowing movement of the sleeves relative to the ports. Still further, once the components are no longer locked in position relative to each other, some of the embodiments are configured to thereafter operate in a "delay mode" where relative movement between the sleeve and the port is delayed insofar as (1) such relative movement occurs but occurs at a reduced and/or controlled rate and/or (2) such relative movement is delayed until the occurrence of a selected wellbore condition. The delay mode may also be referred to as an "unlocked mode" since the sleeves are no longer locked in position relative to the ports. In some embodiments, the sleeve systems may be operated in the delay mode until the sleeve system achieves a "fully open mode" where the sleeve has moved relative to the port to allow maximum fluid communication between the flow bore of the sleeve system and the port of the sleeve system. It will be appreciated that devices, systems, and/or components of sleeve system embodiments that selectively contribute to establishing and/or maintaining the locked mode may be referred to as locking devices, locking systems, locks, movement restrictors, restrictors, and the like. It will also be appreciated that devices, systems, and/or components of sleeve system embodiments that selectively contribute to establishing and/or maintaining the delay mode may be referred to as delay devices, delay systems, delays, timers, contingent openers, and the like.

Also disclosed herein are methods for configuring a plurality of such sleeve systems so that one or more sleeve systems may be selectively transitioned from the installation mode to the delay mode by passing a single obturator through the plurality of sleeve systems. As will be explained below in greater detail, in some embodiments, one or more sleeve systems may be configured to interact with an obturator of a first configuration while other sleeve systems may be configured not to interact with the obturator having the first configuration, but rather, configured to interact with an obturator having a second configuration. Such differences in configurations amongst the various sleeve systems may allow an operator to selectively transition some sleeve systems to the exclusion of other sleeve systems.

Also disclosed herein are methods for performing a wellbore servicing operation employing a plurality of such sleeve systems by configuring such sleeve systems so that one or more of the sleeve systems may be selectively transitioned from the delay mode to the fully open mode at varying time intervals. Such differences in configurations amongst the various sleeve systems may allow an operator to selectively transition some sleeve systems to the exclusion of other sleeve systems, for example, such that a servicing fluid may be communicated (e.g., for the performance of a servicing operation) via a first sleeve system while not being communicated via a second, third, fourth, etc. sleeve system. The following discussion describes various embodiments of sleeve systems, the physical operation of the sleeve systems individually, and methods of servicing wellbores using such sleeve systems.

Referring to FIG. 1, an embodiment of a wellbore servicing system 100 is shown in an example of an operating environment. As depicted, the operating environment comprises a servicing rig 106 (e.g., a drilling, completion, or workover rig) that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner using cement 122. In alternative operating environments, a horizontal wellbore portion may be cased and cemented and/or portions of the wellbore may be uncased. The servicing rig 106 comprises a derrick 108 with a rig floor 110 through which a tubing or work string 112 (e.g., cable, wireline, E-line, Z-line, jointed pipe, coiled tubing, casing, or liner string, etc.) extends downward from the servicing rig 106 into the wellbore 114 and defines an annulus 128 between the work string 112 and the wellbore 114. The work string 112 delivers the wellbore servicing system 100 to a selected depth within the wellbore 114 to perform an operation such as perforating the casing 120 and/or subterranean formation 102, creating perforation tunnels and/or fractures (e.g., dominant fractures, micro-fractures, etc.) within the subterranean formation 102, producing hydrocarbons from the subterranean formation 102, and/or other completion operations. The servicing rig 106 comprises a motor driven winch and other associated equipment for extending the work string 112 into the wellbore 114 to position the wellbore servicing system 100 at the selected depth.

While the operating environment depicted in FIG. 1 refers to a stationary servicing rig 106 for lowering and setting the wellbore servicing system 100 within a land-based wellbore 114, in alternative embodiments, mobile workover rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The subterranean formation 102 comprises a zone 150 associated with deviated wellbore portion 136. The subterranean formation 102 further comprises first, second, third, fourth, and fifth horizontal zones, 150*a*, 150*b*, 150*c*, 150*d*, 150*e*, respectively, associated with the horizontal wellbore portion 118. In this embodiment, the zones 150, 150*a*, 150*b*, 150*c*, 150*d*, 150*e* are offset from each other along the length of the wellbore 114 in the following order of increasingly downhole location: 150, 150*e*, 150*d*, 150*c*, 150*b*, and 150*a*. In this embodiment, stimulation and production sleeve systems 200, 200*a*, 200*b*, 200*c*, 200*d*, and 200*e* are located within wellbore 114 in the work string 112 and are associated with zones 150, 150*a*, 150*b*, 150*c*, 150*d*, and 150*e*, respectively. It will be appreciated that zone isolation devices such as annular isolation devices (e.g., annular packers and/or swellpackers) may be selectively disposed within wellbore 114 in a manner that restricts fluid communication between spaces immediately uphole and downhole of each annular isolation device.

Figure 2:
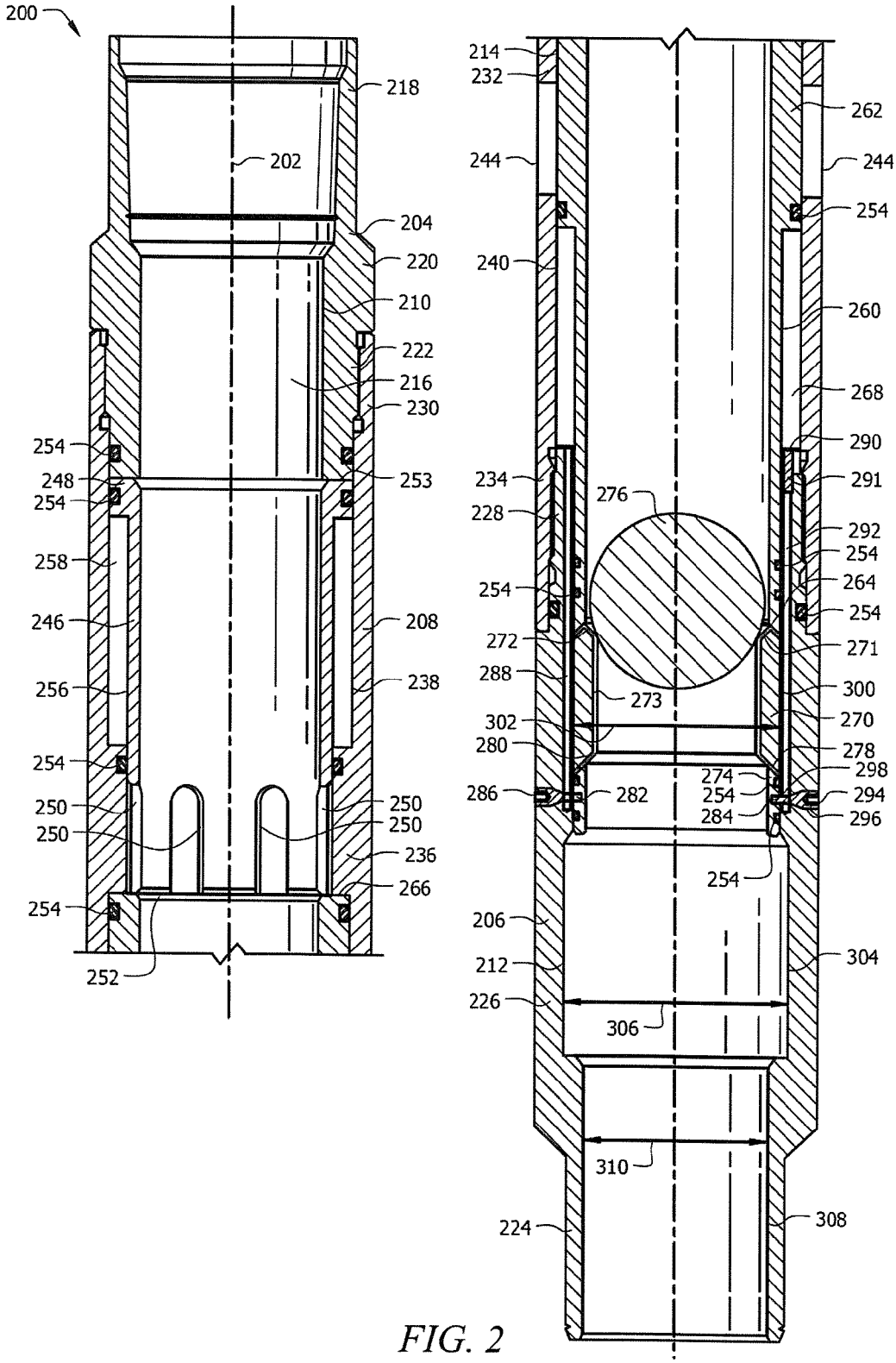
FIG. 2 is a cross-sectional view of a sleeve system of the wellbore servicing system of FIG. 1 showing the sleeve system in an installation mode.

Referring now to FIG. 2, a cross-sectional view of an embodiment of a stimulation and production sleeve system 200 (hereinafter referred to as "sleeve system" 200) is shown. Many of the components of sleeve system 200 lie substantially coaxial with a central axis 202 of sleeve system 200. Sleeve system 200 comprises an upper adapter 204, a lower adapter 206, and a ported case 208. The ported case 208 is joined between the upper adapter 204 and the lower adapter 206. Together, inner surfaces 210, 212, 214 of the upper adapter 204, the lower adapter 206, and the ported case 208, respectively, substantially define a sleeve flow bore 216. The upper adapter 204 comprises a collar 218, a makeup portion 220, and a case interface 222. The collar 218 is internally threaded and otherwise configured for attachment to an element of work string 112 that is adjacent and uphole of sleeve system 200 while the case interface 222 comprises external threads for engaging the ported case 208. The lower adapter 206 comprises a nipple 224, a makeup portion 226, and a case interface 228. The nipple 224 is externally threaded and otherwise configured for attachment to an element of work string 112 that is adjacent and downhole of sleeve system 200 while the case interface 228 also comprises external threads for engaging the ported case 208.

The ported case 208 is substantially tubular in shape and comprises an upper adapter interface 230, a central ported body 232, and a lower adapter interface 234, each having substantially the same exterior diameters. The inner surface 214 of ported case 208 comprises a case shoulder 236 that separates an upper inner surface 238 from a lower inner surface 240. The ported case 208 further comprises ports 244. As will be explained in further detail below, ports 244 are through holes extending radially through the ported case 208 and are selectively used to provide fluid communication between sleeve flow bore 216 and a space immediately exterior to the ported case 208.

The sleeve system 200 further comprises a piston 246 carried within the ported case 208. The piston 246 is substantially configured as a tube comprising an upper seal shoulder 248 and a plurality of slots 250 near a lower end 252 of the piston 246. With the exception of upper seal shoulder 248, the piston 246 comprises an outer diameter smaller than the diameter of the upper inner surface 238. The upper seal shoulder 248 carries a circumferential seal 254 that provides a fluid tight seal between the upper seal shoulder 248 and the upper inner surface 238. Further, case shoulder 236 carries a seal 254 that provides a fluid tight seal between the case shoulder 236 and an outer surface 256 of piston 246. In the embodiment shown and when the sleeve system 200 is configured in an installation mode, the upper seal shoulder 248 of the piston 246 abuts the upper adapter 204. The piston 246 extends from the upper seal shoulder 248 toward the lower adapter 206 so that the slots 250 are located downhole of the seal 254 carried by case shoulder 236. In this embodiment, the portion of the piston 246 between the seal 254 carried by case shoulder 236 and the seal 254 carried by the upper seal shoulder 248 comprises no apertures in the tubular wall (i.e., is a solid, fluid tight wall). As shown in this embodiment and in the installation mode of FIG. 2, a low pressure chamber 258 is located between the outer surface 256 of piston 246 and the upper inner surface 238 of the ported case 208.

The sleeve system 200 further comprises a sleeve 260 carried within the ported case 208 below the piston 246. The sleeve 260 is substantially configured as a tube comprising an upper seal shoulder 262. With the exception of upper seal shoulder 262, the sleeve 260 comprises an outer diameter substantially smaller than the diameter of the lower inner surface 240. The upper seal shoulder 262 carries two circumferential seals 254, one seal 254 near each end (e.g., upper and lower ends) of the upper seal shoulder 262, that provide fluid tight seals between the upper seal shoulder 262 and the lower inner surface 240 of ported case 208. Further, two seals 254 are carried by the sleeve 260 near a lower end 264 of sleeve 260, and the two seals 254 form fluid tight seals between the sleeve 260 and the inner surface 212 of the lower adapter 206. In this embodiment and installation mode shown in FIG. 2, an upper end 266 of sleeve 260 substantially abuts a lower end of the case shoulder 236 and the lower end 252 of piston 246. In this embodiment and installation mode shown in FIG. 2, the upper seal shoulder 262 of the sleeve 260 seals ports 244 from fluid communication with the sleeve flow bore 216. Further, the seal 254 carried near the lower end of the upper seal shoulder 262 is located downhole of (e.g., below) ports 244 while the seal 254 carried near the upper end of the upper seal shoulder 262 is located uphole of (e.g., above) ports 244. The portion of the sleeve 260 between the seal 254 carried near the lower end of the upper seal shoulder 262 and the seals 254 carried by the sleeve 260 near a lower end 264 of sleeve 260 comprises no apertures in the tubular wall (i.e., is a solid, fluid tight wall). As shown in this embodiment and in the installation mode of FIG. 2, a fluid chamber 268 is located between the outer surface of sleeve 260 and the lower inner surface 240 of the ported case 208.

The sleeve system 200 further comprises a segmented seat 270 carried within the lower adapter 206 below the sleeve 260. The segmented seat 270 is substantially configured as a tube comprising an inner bore surface 273 and a chamfer 271 at the upper end of the seat, the chamfer 271 being configured and/or sized to selectively engage and/or retain an obturator of a particular size and/or shape (such as obturator 276). In the embodiment of FIG. 2, the segmented seat 270 may be radially divided with respect to central axis 202 into segments.

Figure 2A:
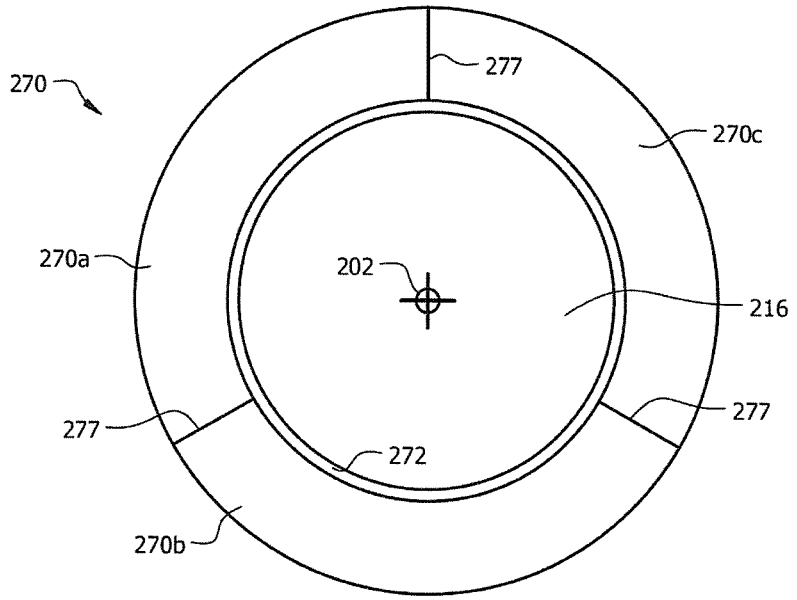
FIG. 2A is a cross-sectional end-view of a segmented seat of the sleeve system of FIG. 2 showing the segmented seat divided into three segments.
Figure 2B:
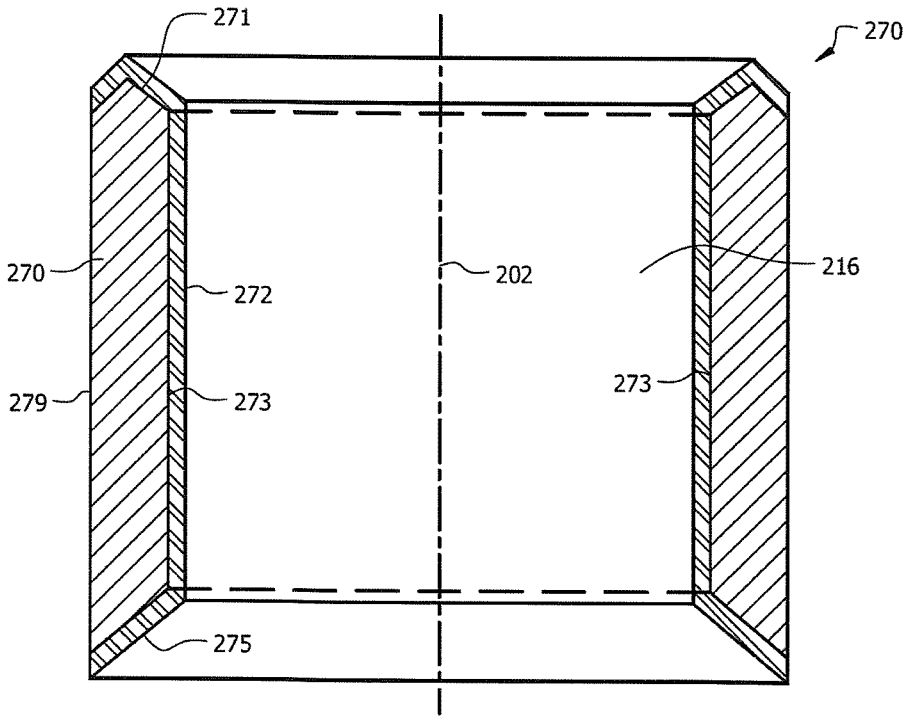
FIG. 2B is a cross-sectional view of a segmented seat of the sleeve system of FIG. 2 having a protective sheath applied thereto.

In FIGS. 2A and 2B one embodiment of the segmented seat is illustrated. Segmented seat 270 is divided (e.g., as represented by dividing or segmenting lines/cuts 277) into three complementary segments of approximately equal size, shape, and/or configuration. In the embodiment of FIG. 2A, the three complementary segments (270*a*, 270*b*, and 270*c*, respectively) together form the segmented seat 270, with each of the segments (270*a*, 270*b*, and 270*c*) constituting about one-third (e.g., extending radially about 120°) of the segmented seat 270.

It will be appreciated that while obturator 276 is shown in FIG. 2 with the sleeve system 200 in an installation mode, in most applications of the sleeve system 200, the sleeve system 200 would be placed downhole without the obturator 276, and the obturator 276 would subsequently be provided as discussed below in greater detail. Further, while the obturator 276 is a ball, an obturator of other embodiments may be any other suitable shape or device for sealing against a protective sheath 272 and or a seat gasket (both of which will be discussed below) and obstructing flow through the sleeve flow bore 216.

In an alternative embodiment, a sleeve system like sleeve system 200 may comprise an expandable seat. Such an expandable seat may be constructed of, for example but not limited to, a low alloy steel such as AISI 4140 or 4130, and is generally configured to be biased radially outward so that if unrestricted radially, a diameter (e.g., outer/inner) of the seat 270 increases. In some embodiments, the expandable seat may be constructed from a generally serpentine length of AISI 4140. For example, the expandable seat may comprise a plurality of serpentine loops between upper and lower portions of the seat and continuing circumferentially to form the seat. In an embodiment, such an expandable seat may be covered by a protective sheath 272 (as will be discussed below) and/or may comprise a seat gasket.

In the embodiment of FIG. 2, one or more surfaces of the segmented seat 270 are covered by a protective sheath 272. Referring to FIG. 2B, an embodiment of the segmented seat 270 and protective sheath 272 are illustrated in greater detail. In the embodiment of FIG. 2B the protective sheath 272 covers the chamfer 271 of the segmented seat 270, the inner bore 273 of the segmented seat 270, and a lower face 275 of the segmented seat 270. In an alternative embodiment, the protective sheath 272 may cover the chamfer 271, the inner bore 273, and a lower face 275, the back 279 of the segmented seat 270, or combinations thereof. In another alternative embodiment, a protective sheath may cover any one or more of the surfaces of a segmented seat 270, as will be appreciated by one of skill in the art viewing this disclosure. In the embodiment illustrated by FIGS. 2, 2A, and 2B, the protective sheath 272 forms a continuous layer over those surfaces of the segmented seat 270 in fluid communication with the sleeve flow bore 216. For example, small crevices or gaps (e.g., at dividing lines 277) may exist at the radially extending divisions between the segments (e.g., 270*a*, 270*b*, and 270*c*) of the segmented seat 270. In an embodiment, the continuous layer formed by the protective sheath 272 may fill, seal, minimize, or cover, any such crevices or gaps such that a fluid flowing via the sleeve flow bore 216 will be impeded from contacting and/or penetrating any such crevices or gaps.

In an embodiment, the protective sheath 272 may be applied to the segmented seat 270 while the segments 270*a*, 270*b*, and 270*c* are retained in a close conformation (e.g., where each segment abuts the adjacent segments, as illustrated in FIG. 2A). For example, the segmented seat 270 may be retained in such a close conformation by bands, bindings, straps, wrappings, or combinations thereof. In an embodiment, the segmented seat 270 may be coated and/or covered with the protective sheath 272 via any suitable method of application. For example, the segmented seat 270 may submerged (e.g., dipped) in a material (as will be discussed below) that will form the protective sheath 272, a material that will form the protective sheath 272 may be sprayed and/or brushed onto the desired surfaces of the segmented seat 270, or combinations thereof. In such an embodiment, the protective sheath 270 may adhere to the segments 270*a*, 270*b*, and 270*c* of the segmented seat 270 and thereby retain the segments in the close conformation.

In an alternative embodiment, the protective sheath 272 may be applied individually to each of the segments 270*a*, 270*b*, and 270*c* of the segmented seat 270. For example, the segments 270*a*, 270*b*, and/or 270*c* may individually submerged (e.g., dipped) in a material that will form the protective sheath 272, a material that will form the protective sheath 272 may be sprayed and/or brushed onto the desired surfaces of the segments 270*a*, 270*b*, and 270*c*, or combinations thereof. In such an embodiment, the protective sheath 272 may adhere to some or all of the surfaces of each of the segments 270*a*, 270*b*, and 270*c*. After the protective sheath 272 has been applied, the segments 270*a*, 270*b*, and 270*c* may be brought together to form the segmented seat 270. In such an embodiment, the protective sheath 272 may be sufficiently malleable or pliable that when the sheathed segments are retained in the close conformation, any crevices or gaps between the segments (e.g., segments 270*a*, 270*b*, and 270*c*) will be filled or minimized by the protective sheath 272 such that a fluid flowing via the sleeve flow bore 216 will be impeded from contacting and/or penetrating any such crevices or gaps.

In still another alternative embodiment, the protective sheath 272 need not be applied directly to the segmented seat 270. For example, a protective sheath may be fitted to or within the segmented seat 270, draped over a portion of segmented seat 270, or the like. The protective sheath may comprise a sleeve or like insert configured and sized to be positioned within the bore of the segmented sheath and to fit against the chamfer 271 of the segmented seat 270, the inner bore 273 of the segmented seat 270, and/or the lower face 275 of the segmented seat 270 and thereby form a continuous layer that may fill, seal, or cover, any such crevices or gaps such that a fluid flowing via the sleeve flow bore 216 will be impeded from contacting and/or penetrating any such crevices or gaps. In another embodiment where the protective sheath 272 comprises a heat-shrinkable material (as will be discussed below), such a material may be positioned over, around, within, about, or similarly, at least a portion of the segmented seat 270 and/or one or more of the segments 270*a*, 270*b*, and 270*c*, and heated sufficiently to cause the shrinkable material to shrink to the surfaces of the segmented seat 270 and/or the segments 270*a*, 270*b*, and 270*c*.

In an embodiment, the protective sheath 272 may be formed from a suitable material. Nonlimiting examples of such a suitable material include ceramics, carbides, hardened plastics, molded rubbers, various heat-shrinkable materials, or combinations thereof. In an embodiment, the protective sheath may be characterized as having a hardness of from about 25 durometers to about 150 durometers, alternatively, from about 50 durometers to about 100 durometers, alternatively, from about 60 durometers to about 80 durometers. In an embodiment, the protective sheath may be characterized as having a thickness of from about $1/64^{th}$ of an inch to about $3/16^{th}$ of an inch, alternatively, about $1/32^{nd}$ of an inch. Examples of materials suitable for the formation of the protective sheath include nitrile rubber, which commercially available from several rubber, plastic, and/or composite materials companies.

In an embodiment, a protective sheath, like protective sheath 272, may be employed to advantageously lessen the degree of erosion and/or degradation to a segmented seat, like segmented seat 270. Not intending to be bound by theory, such a protective sheath may improve the service life of a segmented seat covered by such a protective sheath by decreasing the impingement of erosive fluids (e.g., cutting, hydrojetting, and/or fracturing fluids comprising abrasives and/or proppants) with the segmented seat. In an embodiment, a segmented seat protected by such a protective sheath may have a service life at least 20% greater, alternatively, at least 30% greater, alternatively, at least 35% greater than an otherwise similar seat not protected by such a protective sheath.

In an embodiment, the segmented seat 270 may further comprise a seat gasket that serves to seal against an obturator. In some embodiments, the seat gasket may be constructed of rubber. In such an embodiment and installation mode, the seat gasket may be substantially captured between the expandable seat and the lower end of the sleeve. In an embodiment, the protective sheath 272 may serve as such a gasket, for example, by engaging and/or sealing an obturator. In such an embodiment, the protective sheath 272 may have a variable thickness. For example, the surface(s) of the protective sheath 272 configured to engage the obturator (e.g., chamfer 271) may comprise a greater thickness than the one or more other surfaces of the protective sheath 272.

As illustrated in FIGS. 2C-2L, the segments of the segmented seat may be assembled without a protective sheath and retained in close conformation by retainers mounted in recesses, such as bands, bindings, straps, wrappings, or combinations thereof. As used herein, the term "recess" is used to include voids (grooves, cavities and chambers) in the metallic portion of the segments. These retainers can be made from materials, suitable for the formation of the retainers, such as rubber, plastic, and/or composite materials which will stretch, tear, break, or disintegrate when the segments separate. Examples of suitable materials include: any elastomer (rubber), polymer (plastics), composites, cement, and/or synthetics. By eliminating the protective sheath from the inner bore surface, a proportionally larger inner bore can be used. Throughout FIGS. 2A-L, the last two digits of the reference numbers are used to designate like or corresponding parts in these various embodiments.

According to a particular feature of the embodiments illustrated in FIGS. 2C-L, the lower of downhole facing surface of the seat has notches that function to hold the seat in place during drill out. In these embodiments the notches are identified by reference numerals 375A, 475A, 575A, 675A and 775A and comprise segments sit axially extending shoulders 375B, 475B, 575B, 675B and 775B respectively. As illustrated in FIG. 2M, the shoulder formed between the seat catch bore 304 and the lower central bore 308, contains up hole facing teeth or protrusions 375C that fit in notches to lock the seat against rotation during drill out. Other corresponding locking or engaging shapes could be used for the notches and protrusions, such as, for example ratchet teeth, pins, or the like.

FIGS. 2C and 2D illustrate an alternative segmented seat 370 embodiment. Seat 370 has a generally cylindrical outer wall 379, a cylindrical inner bore 373 and double tapered upper end wall 371 and lower end wall 375. The inwardly facing chamfer surface on end upper wall 371 is of a size and shape to engage an obturator and restrict flow through the bore 373. The outwardly tapered chamfer on wall 371 is of a size and shape to engage a mating downwardly facing annular shoulder on lower adapter 206. The chamfer surface on end wall 375 acts as a guide for tools moving through the seat. In this embodiment, at least a portion of the upper end wall 371 and lower end wall 375 is metallic. The metallic portion of the upper end wall 371 engages the shoulder on the lower adapter 206. The metallic surface on the lower end wall 375 and grooves 375A engage the shoulder formed between the seat catch bore 304 and the lower central bore 308.

In the FIGS. 2C and 2D embodiment, three segmented seats 370A, 370B and 370C are held together by an annular retainer 372 mounted in an annular groove 372A. As is illustrated, the groove 372A is a general trapezoid-shaped cross section which tapers inwardly from the outer wall 379 of the seat. The annular retainer 372 has a matching cross section. As an additional advantage of this embodiment, the retainer 372 acts as an annular seal ring around the segmented seat 370.

In this embodiment, the retainer 372 can be molded into the groove 372A with the segments assembled the position illustrated in FIG. 2C. Alternatively, the retainer 372 can be formed from a band of flexible material which can be stretched and then inserted in the groove 372A to hold the segments is assembled in an annular shape.

In this embodiment, segments are formed from materials such as cast-iron which are rigid yet accommodate removed from the well by drilling/milling. Such materials include composites, cast-iron, brass, aluminum and the like. According to a particular feature of this embodiment, the upward facing chamfer seat surface 371 for receiving is formed from the rigid material of the segments. Also, in this embodiment the tapered lower face 375 is formed from the rigid material of the segments and functions to deflect tools with being upward through the inner bore.

By installing the retainer 372 in the outer wall 379, the interior bore 373 surface need not be coated with sheath material, thus enlarging the proportional size of the inter-bore. In addition, segmented seat 370 becomes easier to drill.

In FIGS. 2E and 2F an alternative segmented seat 470 embodiment is illustrated in which multiple retainers 472 are located internally. As illustrated in FIG. 2E, each of these segments 470A, 470B and 470C have voids are cavities 472 formed by drilling or casting processes. In the illustrated embodiment, the cavities 472*a* are formed by intersecting drillings, originating in the faces formed by the dividing line 477. Each of the cavities for 472 has one or more ports 470*b* for injecting a settable material for forming the retainers 472. As in the earlier retainer embodiment, this embodiment provides the advantage of an enlarged inner bore and the enhanced drillability.

Figure 2G:
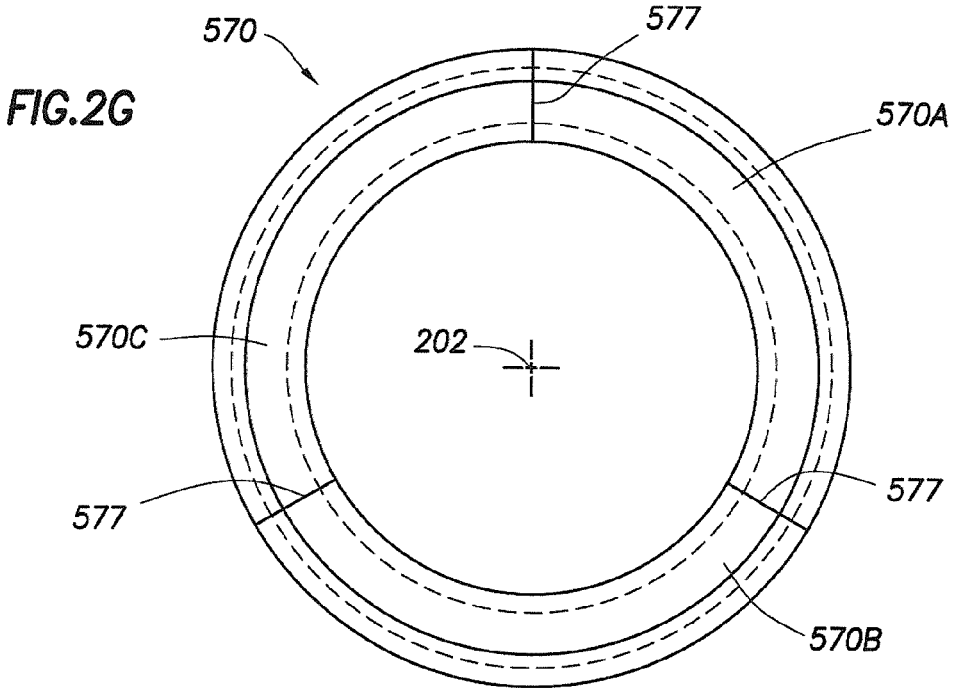
FIG. 2G is a top plan view of third alternative embodiment of the segmented seat of the sleeve system of FIG. 2.
Figure 2H:
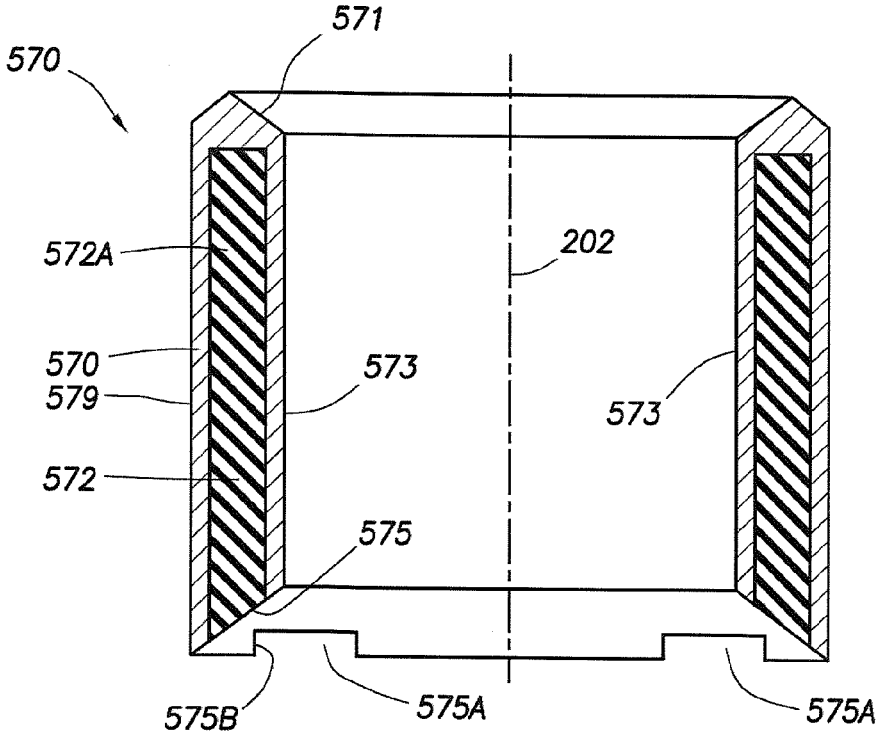
FIG. 2H is a cross-sectional view of the segmented seat embodiment of FIG. 2G.

In FIGS. 2G and 2H, a further embodiment of a segmented seat 570 formed from segments 570A, 570B and 570C is illustrated in which the retainer 572 is mounted in an annular-shaped slot or groove 572*a*. The slot 572*a* has a generally rectangular cross section and extends from the lower face 575 upward to just short of the seat surface 571. The walls of the slot 572*a* extend in general parallel relationship to the inner bore surface 573 in our well 579. The retainer 572 can be formed in place from settable material.

In FIGS. 2I and 2J, an even further embodiment of the segmented seat 670 formed from the segments 670A, 670B, 670C is illustrated as having a plurality of retainers 672, mounted in external annular grooves 672*a* which extend continuously around back wall 679 of the segments. As illustrated, grooves 672*a* have a parallel side walls and a curved inner or bottom wall. It is envisioned that the grooves could have other cross-sectional shapes, not illustrated, such as, for example, semicircular, v-shaped, tapered, parabolic, and the like. In the illustrated embodiment, the retainers 672 can be cast in place or separately formed as bands which then are stretched over and inserted into the grooves 670*a*.

In another embodiment illustrated in FIGS. 2I and 2J, grooves 672*a* and retainer 672 are formed in a continuous spiral.

In a further embodiment illustrated in FIGS. 2I and 2J, grooves 672*a* and retainers 672 do not extend completely around segmented seat 670. Instead, each of the grooves 272*a* and retainers 272 only extend between at least two but not both adjacent segments. For example, one or more retainers extend between and connect segments 570A and 570B, one or more different retainers extend between and connect segments 570B and 570C, while a one or more even different retainers extend between and connect segment 570C and 570A.

It is also envisioned, that one retainer could connect segment 570A to 570B and extend to connect segment 570B to 570C but does not extend to connect segment 570C to segment 570A. Alternatively, one or more of these segments could overlap to join all of the segments together.

Figure 2K:
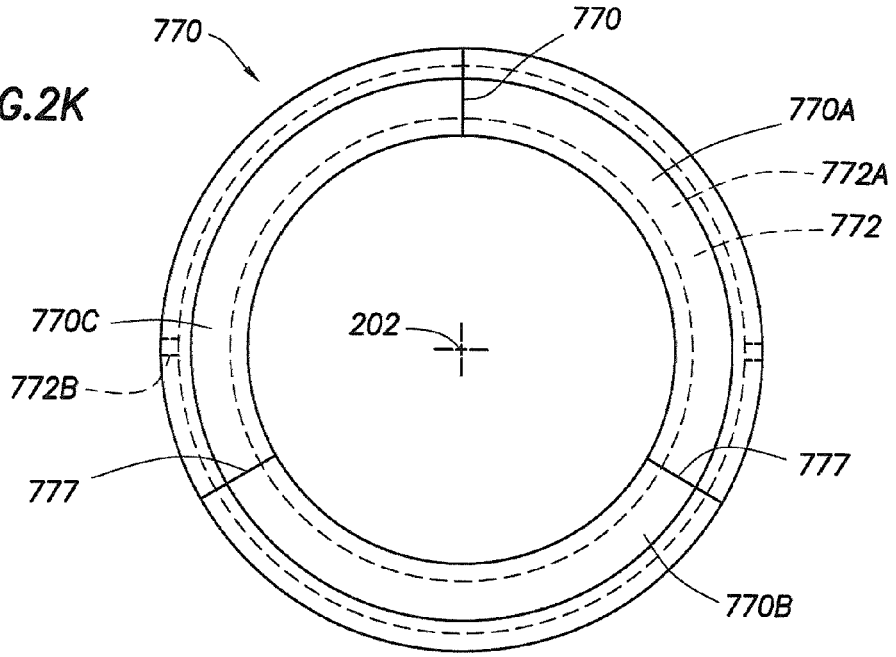
FIG. 2K is a top plan view of forth alternative embodiment of the segmented seat of the sleeve system of FIG. 2.
Figure 2L:
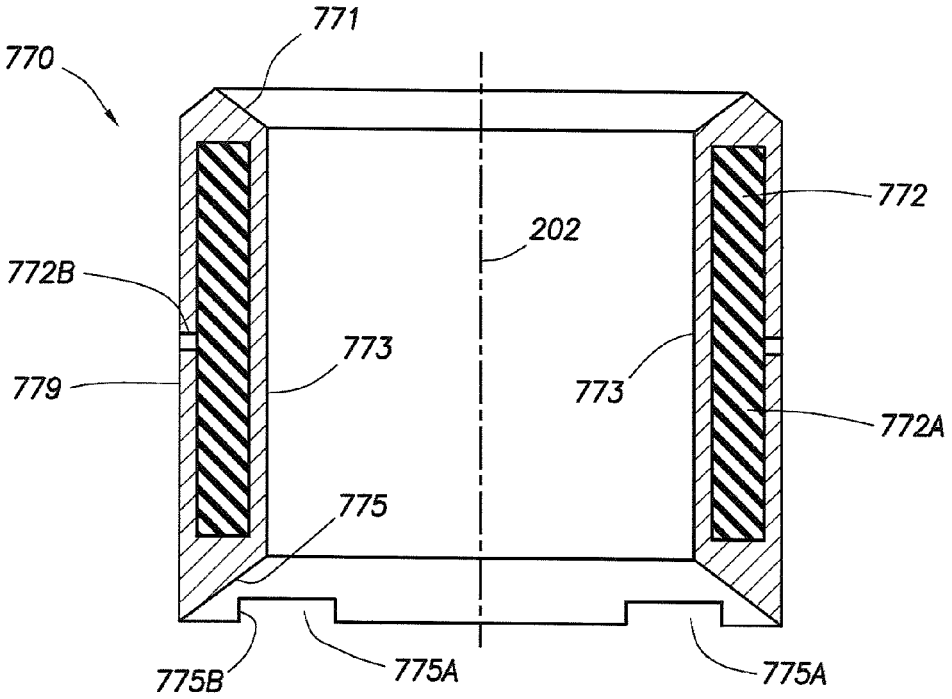
FIG. 2L is a cross-sectional view of the segmented seat embodiment of FIG. 2K.

In FIGS. 2K and 2L, an additional embodiment of the segmented seat 770 formed from segments 770A, 770B, and 770C is illustrated as having a retainer 772 located in an internal cavity or chamber 772*a*. When the segments are assembled together to form seat 770, chamber 772 has an annular shape and is completely enclosed. Chamber 770 has a generally rectangular cross-section shape with its sidewalls extending generally parallel to the inner wall 773 and does not extend into either the seat surface 771 or lower face 775. It is envisioned that the chamber 772*a* could be formed in various shapes when the segments are formed. One or more ports 772*b* communicating with the chamber 772*a* can be provided to inject material to form the retainer 772.

In the segmented seat embodiments, the seat may comprise any suitable number of equally or unequally-divided segments. For example, a segmented seat may comprise two, four, five, six, or more complementary, radial segments. The segmented seat may be formed from a suitable material. Nonlimiting examples of such a suitable material include composites, phenolics, cast iron, aluminum, brass, various metal alloys, rubbers, ceramics, or combinations thereof. In an embodiment, the material employed to form the segmented seat may be characterized as drillable, that is, the segmented seat may be fully or partially degraded or removed by drilling, as will be appreciated by one of skill in the art with the aid of this disclosure. The individual segments may be formed independently or, alternatively, a preformed seat may be divided into segments.

The sleeve system 200 further comprises a seat support 274 carried within the lower adapter 206 below the seat 270. The seat support 274 is substantially formed as a tubular member. The seat support 274 comprises an outer chamfer 278 on the upper end of the seat support 274 that selectively engages an inner chamfer 280 on the lower end of the segmented seat 270. The seat support 274 comprises a circumferential channel 282. The seat support 274 further comprises two seals 254, one seal 254 carried uphole of (e.g., above) the channel 282 and the other seal 254 carried downhole of (e.g., below) the channel 282, and the seals 254 form a fluid seal between the seat support 274 and the inner surface 212 of the lower adapter 206. In this embodiment and when in installation mode as shown in FIG. 2, the seat support 274 is restricted from downhole movement by a shear pin 284 that extends from the lower adapter 206 and is received within the channel 282. Accordingly, each of the seat 270, protective sheath 272, sleeve 260, and piston 246 are captured between the seat support 274 and the upper adapter 204 due to the restriction of movement of the seat support 274.

The lower adapter 206 further comprises a fill port 286, a fill bore 288, a metering device receptacle 290, a drain bore 292, and a plug 294. In this embodiment, the fill port 286 comprises a check valve device housed within a radial through bore formed in the lower adapter 206 that joins the fill bore 288 to a space exterior to the lower adapter 206. The fill bore 288 is formed as a substantially cylindrical longitudinal bore that lies substantially parallel to the central axis 202. The fill bore 288 joins the fill port 286 in fluid communication with the fluid chamber 268. Similarly, the metering device receptacle 290 is formed as a substantially cylindrical longitudinal bore that lies substantially parallel to the central axis 202. The metering device receptacle 290 joins the fluid chamber 268 in fluid communication with the drain bore 292. Further, drain bore 292 is formed as a substantially cylindrical longitudinal bore that lies substantially parallel to the central axis 202. The drain bore 292 extends from the metering device receptacle 290 to each of a plug bore 296 and a shear pin bore 298. In this embodiment, the plug bore 296 is a radial through bore formed in the lower adapter 206 that joins the drain bore 292 to a space exterior to the lower adapter 206. The shear pin bore 298 is a radial through bore formed in the lower adapter 206 that joins the drain bore 292 to sleeve flow bore 216. However, in the installation mode shown in FIG. 2, fluid communication between the drain bore 292 and the flow bore 216 is obstructed by seat support 274, seals 254, and shear pin 284.

The sleeve system 200 further comprises a fluid metering device 291 received at least partially within the metering device receptacle 290. In this embodiment, the fluid metering device 291 is a fluid restrictor, for example a precision microhydraulics fluid restrictor or micro-dispensing valve of the type produced by The Lee Company of Westbrook, Conn. However, it will be appreciated that in alternative embodiments any other suitable fluid metering device may be used. For example, any suitable electro-fluid device may be used to selectively pump and/or restrict passage of fluid through the device. In further alternative embodiments, a fluid metering device may be selectively controlled by an operator and/or computer so that passage of fluid through the metering device may be started, stopped, and/or a rate of fluid flow through the device may be changed. Such controllable fluid metering devices may be, for example, substantially similar to the fluid restrictors produced by The Lee Company. Suitable commercially available examples of such a fluid metering device include the JEVA1835424H and the JEVA1835385H, commercially available from The Lee Company.

The lower adapter 206 may be described as comprising an upper central bore 300 having an upper central bore diameter 302, the seat catch bore 304 having a seat catch bore diameter 306, and a lower central bore 308 having a lower central bore diameter 310. The upper central bore 300 is joined to the lower central bore 308 by the seat catch bore 304. In this embodiment, the upper central bore diameter 302 is sized to closely fit an exterior of the seat support 274, and in an embodiment is about equal to the diameter of the outer surface of the sleeve 260. However, the seat catch bore diameter 306 is substantially larger than the upper central bore diameter 302, thereby allowing radial expansion of the expandable seat 270 when the expandable seat 270 enters the seat catch bore 304 as described in greater detail below. However, the seat catch bore diameter 306 is substantially larger than the upper central bore diameter 302, thereby allowing radial expansion of the expandable seat 270 when the expandable seat 270 enters the seat catch bore 304 as described in greater detail below. Accordingly, as described in greater detail below, while the seat support 274 closely fits within the upper central bore 300 and loosely fits within the seat catch bore diameter 306, the seat support 274 is too large to fit within the lower central bore 308.

Figure 3:
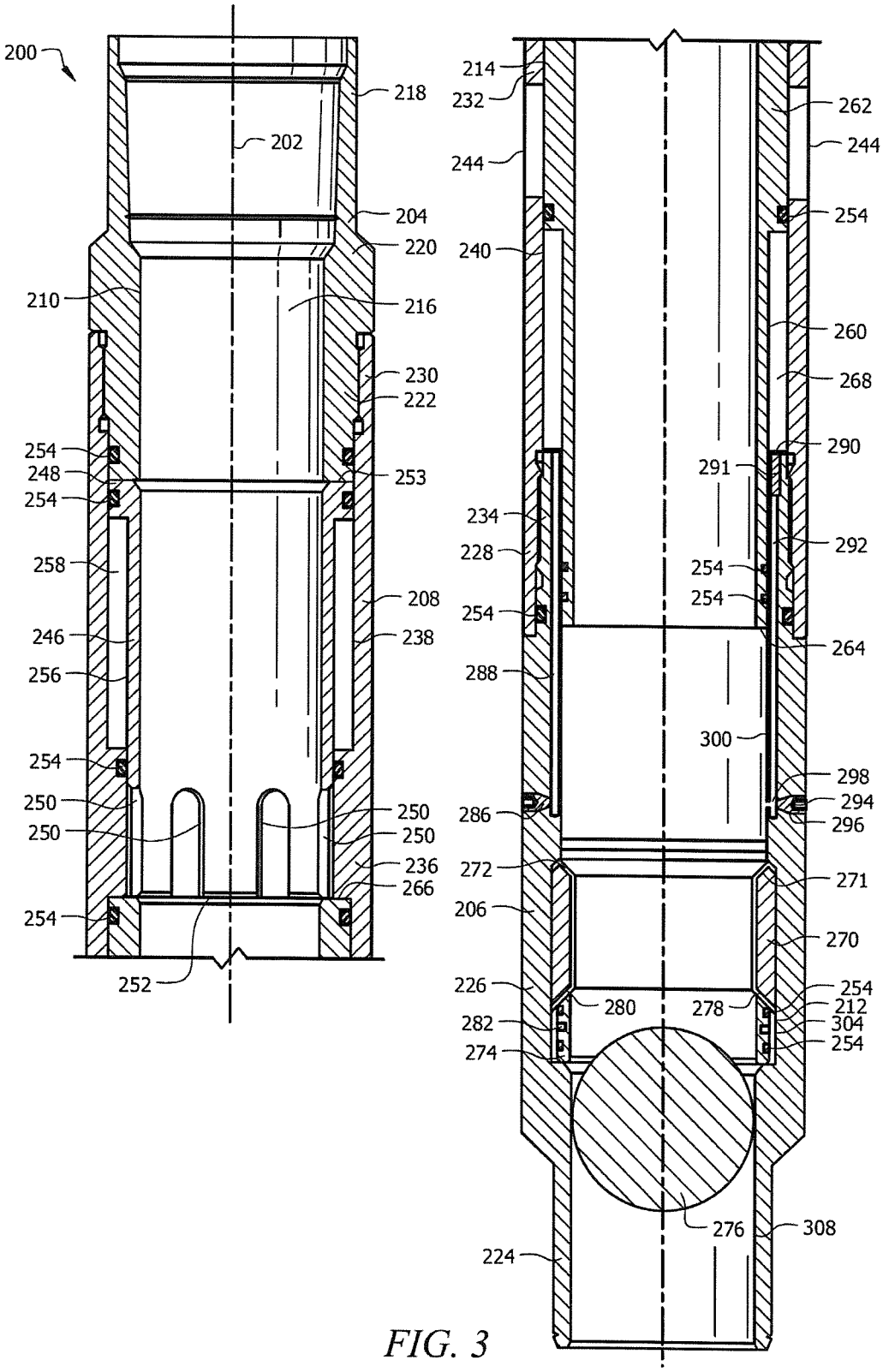
FIG. 3 is a cross-sectional view of the sleeve system of FIG. 2 showing the sleeve system in a delay mode.
Figure 4:
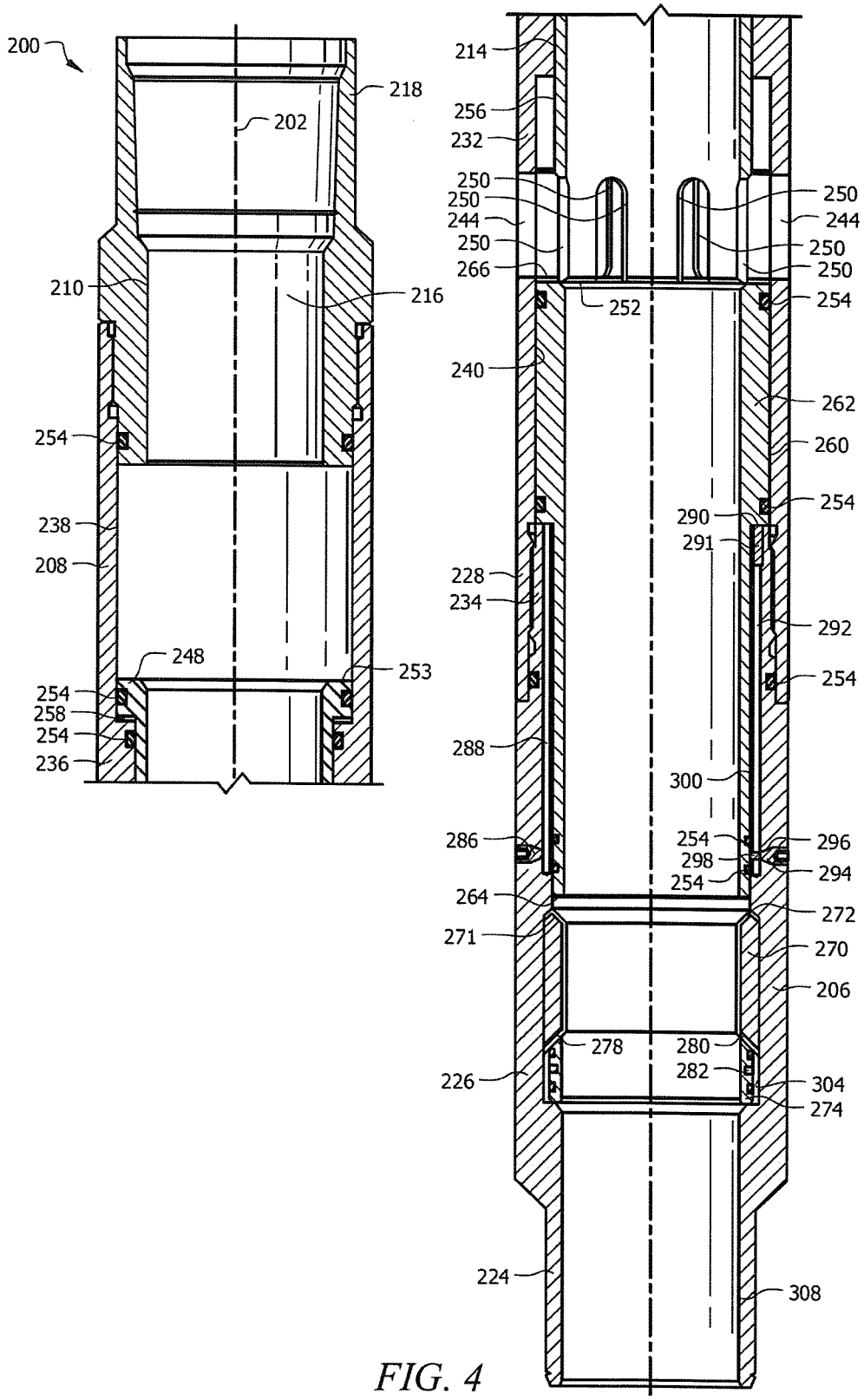
FIG. 4 is a cross-sectional view of the sleeve system of FIG. 2 showing the sleeve system in a fully open mode.

Referring now to FIGS. 2-4, a method of operating the sleeve system 200 is described below. Most generally, FIG. 2 shows the sleeve system 200 in an "installation mode" where sleeve 260 is restricted from moving relative to the ported case 208 by the shear pin 284. FIG. 3 shows the sleeve system 200 in a "delay mode" where sleeve 260 is no longer restricted from moving relative to the ported case 208 by the shear pin 284 but remains restricted from such movement due to the presence of a fluid within the fluid chamber 268. Finally, FIG. 4 shows the sleeve system 200 in a "fully open mode" where sleeve 260 no longer obstructs a fluid path between ports 244 and sleeve flow bore 216, but rather, a fluid path is provided between ports 244 and the sleeve flow bore 216 through slots 250 of the piston 246.

Referring now to FIG. 2, while the sleeve system 200 is in the installation mode, each of the piston 246, sleeve 260, protective sheath 272, segmented seat 270, and seat support 274 are all restricted from movement along the central axis 202 at least because the shear pin 284 is received within both the shear pin bore 298 of the lower adapter 206 and within the circumferential channel 282 of the seat support 274. Also in this installation mode, low pressure chamber 258 is provided a volume of compressible fluid at atmospheric pressure. It will be appreciated that the fluid within the low pressure chamber 258 may be air, gaseous nitrogen, or any other suitable compressible fluid. Because the fluid within the low pressure chamber 258 is at atmospheric pressure, when sleeve system 200 is located downhole, the fluid pressure within the sleeve flow bore 216 is substantially greater than the pressure within the low pressure chamber 258. Such a pressure differential may be attributed in part due to the weight of the fluid column within the sleeve flow bore 216, and in some circumstances, also due to increased pressures within the sleeve flow bore 216 caused by pressurizing the sleeve flow bore 216 using pumps. Further, a fluid is provided within the fluid chamber 268. Generally, the fluid may be introduced into the fluid chamber 268 through the fill port 286 and subsequently through the fill bore 288. During such filling of the fluid chamber 268, one or more of the shear pin 284 and the plug 294 may be removed to allow egress of other fluids or excess of the filling fluid. Thereafter, the shear pin 284 and/or the plug 294 may be replaced to capture the fluid within the fill bore 288, fluid chamber 268, the metering device 291, and the drain bore 292. With the sleeve system 200 and installation mode described above, though the sleeve flow bore 216 may be pressurized, movement of the above-described restricted portions of the sleeve system 200 remains restricted.

Referring now to FIG. 3, the obturator 276 may be passed through the work string 112 until the obturator 276 substantially seals against the protective sheath 272 (as shown in FIG. 2), alternatively, the seat gasket in embodiments where a seat gasket is present. With the obturator 276 in place against the protective sheath 272 and/or seat gasket, the pressure within the sleeve flow bore 216 may be increased uphole of the obturator until the obturator 276 transmits sufficient force through the protective sheath 272, the segmented seat 270, and the seat support 274 to cause the shear pin 284 to shear. Once the shear pin 284 has sheared, the obturator 276 drives the protective sheath 272, the segmented seat 270, and the seat support 274 downhole from their installation mode positions. However, even though the sleeve 260 is no longer restricted from downhole movement by the protective sheath 272 and the segmented seat 270, downhole movement of the sleeve 260 and the piston 246 above the sleeve 260 is delayed. Once the protective sheath 272 and the segmented seat 270 no longer obstruct downward movement of the sleeve 260, the sleeve system 200 may be referred to as being in a "delayed mode."

More specifically, downhole movement of the sleeve 260 and the piston 246 are delayed by the presence of fluid within fluid chamber 268. With the sleeve system 200 in the delay mode, the relatively low pressure within the low pressure chamber 258 in combination with relatively high pressures within the sleeve flow bore 216 acting on the upper end 253 of the piston 246, the piston 246 is biased in a downhole direction. However, downhole movement of the piston 246 is obstructed by the sleeve 260. Nonetheless, downhole movement of the obturator 276, the protective sheath 272, the segmented seat 270, and the seat support 274 are not restricted or delayed by the presence of fluid within fluid chamber 268. Instead, the protective sheath 272, the segmented seat 270, and the seat support 274 move downhole into the seat catch bore 304 of the lower adapter 206. While within the seat catch bore 304, the protective sheath 272 expands, tears, breaks, or disintegrates, thereby allowing the segmented seat 270 to expand radially at the divisions between the segments (e.g., 270*a*, 270*b*, and 270*c*) to substantially match the seat catch bore diameter 306. In an embodiment where a band, strap, binding, or the like is employed to hold segments (e.g., 270*a*, 270*b*, and 270*c*) of the segmented seat 270 together, such band, strap, or binding may similarly expand, tear, break, or disintegrate to allow the segmented seat 270 to expand. The seat support 274 is subsequently captured between the expanded seat 270 and substantially at an interface (e.g., a shoulder formed) between the seat catch bore 304 and the lower central bore 308. For example, the outer diameter of seat support 274 is greater than the lower central bore diameter 310. Once the seat 270 expands sufficiently, the obturator 276 is free to pass through the expanded seat 270, through the seat support 274, and into the lower central bore 308. In an alternative embodiment, the segmented seat 270, the segments (e.g., 270*a*, 270*b*, and 270*c*) thereof, the protective sheath 272, or combinations thereof may be configured to disintegrate when acted upon by the obturator 276 as described above. In such an embodiment, the remnants of the segmented seat 270, the segments (e.g., 270*a*, 270*b*, and 270*c*) thereof, or the protective sheath 272 may fall (e.g., by gravity) or be washed (e.g., by movement of a fluid) out of the sleeve flow bore 216. In either embodiment and as will be explained below in greater detail, the obturator 276 is then free to exit the sleeve system 200 and flow further downhole to interact with additional sleeve systems.

Even after the exiting of the obturator 276 from sleeve system 200, downhole movement of the sleeve 260 occurs at a rate dependent upon the rate at which fluid is allowed to escape the fluid chamber 268 through the fluid metering device 291. It will be appreciated that fluid may escape the fluid chamber 268 by passing from the fluid chamber 268 through the fluid metering device 291, through the drain bore 292, through the shear pin bore 298 around the remnants of the sheared shear pin 284, and into the sleeve flow bore 216. As the volume of fluid within the fluid chamber 268 decreases, the sleeve 260 moves in a downhole direction until the upper seal shoulder 262 of the sleeve 260 contacts the lower adapter 206 near the metering device receptacle 290. It will be appreciated that shear pins or screws with central bores that provide a convenient fluid path may be used in place of shear pin 284.

Referring now to FIG. 4, when substantially all of the fluid within fluid chamber 268 has escaped, sleeve system 200 is in a "fully open mode." In the fully open mode, upper seal shoulder 262 of sleeve 260 contacts lower adapter 206 so that the fluid chamber 268 is substantially eliminated. Similarly, in a fully open mode, the upper seal shoulder 248 of the piston 246 is located substantially further downhole and has compressed the fluid within low pressure chamber 258 so that the upper seal shoulder 248 is substantially closer to the case shoulder 236 of the ported case 208. With the piston 246 in this position, the slots 250 are substantially aligned with ports 244 thereby providing fluid communication between the sleeve flow bore 216 and the ports 244. It will be appreciated that the sleeve system 200 is configured in various "partially opened modes" when movement of the components of sleeve system 200 provides fluid communication between sleeve flow bore 216 and the ports 244 to a degree less than that of the "fully open mode." It will further be appreciated that with any degree of fluid communication between the sleeve flow bore 216 and the ports 244, fluids may be forced out of the sleeve system 200 through the ports 244, or alternatively, fluids may be passed into the sleeve system 200 through the ports 244.

Figure 5:
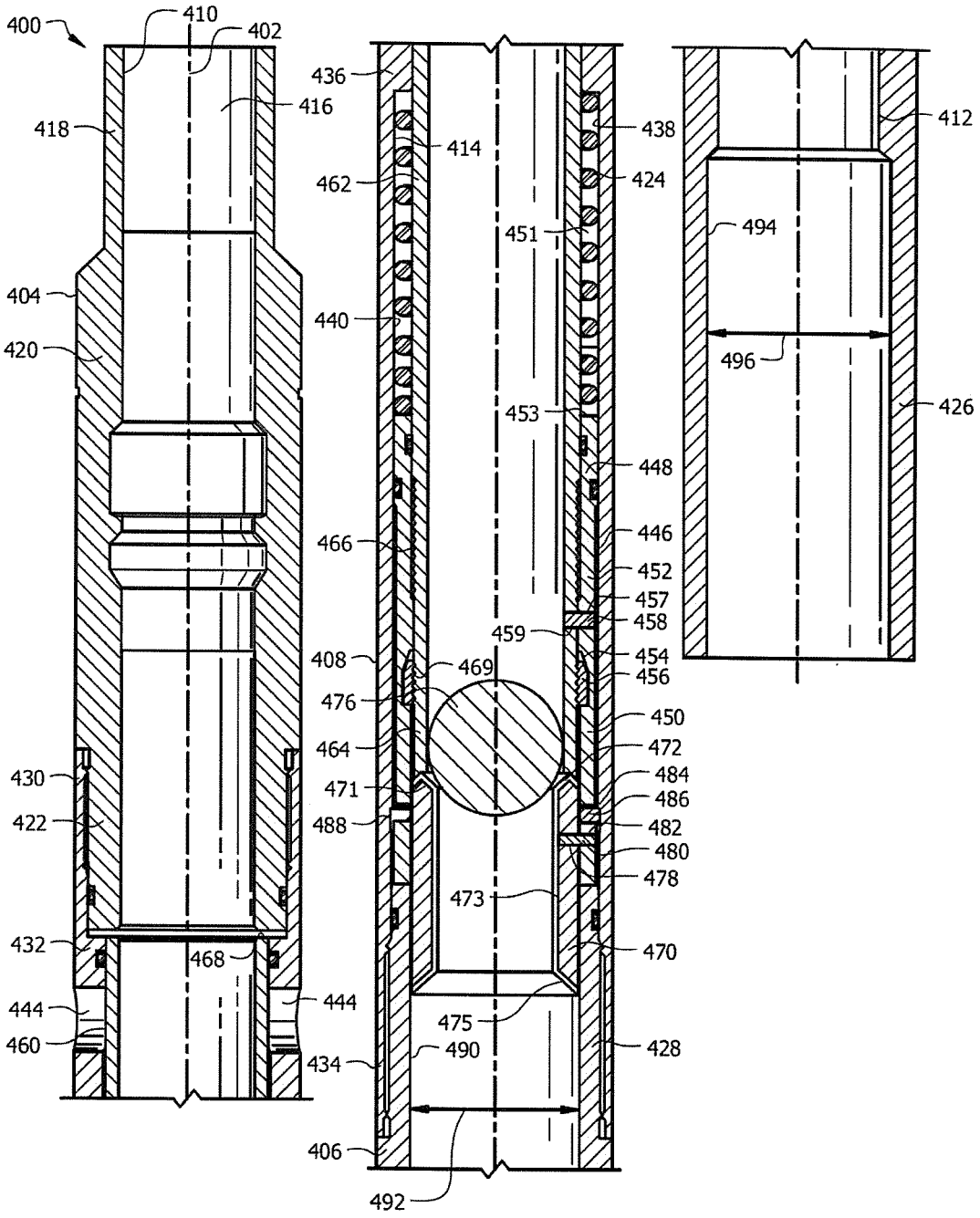
FIG. 5 is a cross-sectional view of an alternative embodiment of a sleeve system according to the disclosure showing the sleeve system in an installation mode.

Referring now to FIG. 5, a cross-sectional view of an alternative embodiment of a stimulation and production sleeve system 400 (hereinafter referred to as "sleeve system" 400) is shown. Many of the components of sleeve system 400 lie substantially coaxial with a central axis 402 of sleeve system 400. Sleeve system 400 comprises an upper adapter 404, a lower adapter 406, and a ported case 408. The ported case 408 is joined between the upper adapter 404 and the lower adapter 406. Together, inner surfaces 410, 412 of the upper adapter 404 and the lower adapter 406, respectively, and the inner surface of the ported case 408 substantially define a sleeve flow bore 416. The upper adapter 404 comprises a collar 418, a makeup portion 420, and a case interface 422. The collar 418 is internally threaded and otherwise configured for attachment to an element of a work string, such as for example, work string 112, that is adjacent and uphole of sleeve system 400 while the case interface 422 comprises external threads for engaging the ported case 408. The lower adapter 406 comprises a makeup portion 426 and a case interface 428. The lower adapter 406 is configured (e.g., threaded) for attachment to an element of a work string that is adjacent and downhole of sleeve system 400 while the case interface 428 comprises external threads for engaging the ported case 408.

The ported case 408 is substantially tubular in shape and comprises an upper adapter interface 430, a central ported body 432, and a lower adapter interface 434, each having substantially the same exterior diameters. The inner surface 414 of ported case 408 comprises a case shoulder 436 between an upper inner surface 438 and ports 444. A lower inner surface 440 is adjacent and below the upper inner surface 438, and the lower inner surface 440 comprises a smaller diameter than the upper inner surface 438. As will be explained in further detail below, ports 444 are through holes extending radially through the ported case 408 and are selectively used to provide fluid communication between sleeve flow bore 416 and a space immediately exterior to the ported case 408.

The sleeve system 400 further comprises a sleeve 460 carried within the ported case 408 below the upper adapter 404. The sleeve 460 is substantially configured as a tube comprising an upper section 462 and a lower section 464. The lower section 464 comprises a smaller outer diameter than the upper section 462. The lower section 464 comprises circumferential ridges or teeth 466. In this embodiment and when in installation mode as shown in FIG. 5, an upper end 468 of sleeve 460 substantially abuts the upper adapter 404 and extends downward therefrom, thereby blocking fluid communication between the ports 444 and the sleeve flow bore 416.

The sleeve system 400 further comprises a piston 446 carried within the ported case 408. The piston 446 is substantially configured as a tube comprising an upper portion 448 joined to a lower portion 450 by a central body 452. In the installation mode, the piston 446 abuts the lower adapter 406. Together, an upper end 453 of piston 446, upper sleeve section 462, the upper inner surface 438, the lower inner surface 440, and the lower end of case shoulder 436 form a bias chamber 451. In this embodiment, a compressible spring 424 is received within the bias chamber 451 and the spring 424 is generally wrapped around the sleeve 460. The piston 446 further comprises a c-ring channel 454 for receiving a c-ring 456 therein. The piston also comprises a shear pin receptacle 457 for receiving a shear pin 458 therein. The shear pin 458 extends from the shear pin receptacle 457 into a similar shear pin aperture 459 that is formed in the sleeve 460. Accordingly, in the installation mode shown in FIG. 5, the piston 446 is restricted from moving relative to the sleeve 460 by the shear pin 458. It will be appreciated that the c-ring 456 comprises ridges or teeth 469 that complement the teeth 466 in a manner that allows sliding of the c-ring 456 upward relative to the sleeve 460 but not downward while the sets of teeth 466, 469 are engaged with each other.

The sleeve system 400 further comprises a segmented seat 470 carried within the piston 446 and within an upper portion of the lower adapter 406. In the embodiment of FIG. 5, the segmented seat 470 is substantially configured as a tube comprising an inner bore surface 473 and a chamfer 471 at the upper end of the seat, the chamfer 471 being configured and/or sized to selectively engage and/or retain an obturator of a particular size and/or shape (such as obturator 476). Similar to the segmented seat 270 disclosed above with respect to FIGS. 2-4, in the embodiment of FIG. 5 the segmented seat 470 may be radially divided with respect to central axis 402 into segments. For example, like the segmented seat 270 illustrated in FIG. 2A, the segmented seat 470 is divided into three complementary segments of approximately equal size, shape, and/or configuration. In an embodiment, the three complementary segments (similar to segments 270*a*, 270*b*, and 270*c* disclosed with respect to FIG. 2A) together form the segmented seat 470, with each of the segments constituting about one-third (e.g., extending radially about 120°) of the segmented seat 470. In an alternative embodiment, a segmented seat like segmented seat 470 may comprise any suitable number of equally or unequally-divided segments. For example, a segmented seat may comprise two, four, five, six, or more complementary, radial segments. The segmented seat 470 may be formed from a suitable material and in any suitable manner, for example, as disclosed above with respect to segmented seat 270 illustrated in FIGS. 2-4. It will be appreciated that while obturator 476 is shown in FIG. 5 with the sleeve system 400 in an installation mode, in most applications of the sleeve system 400, the sleeve system 400 would be placed downhole without the obturator 476, and the obturator 476 would subsequently be provided as discussed below in greater detail. Further, while the obturator 476 is a ball, an obturator of other embodiments may be any other suitable shape or device for sealing against a protective sheath 272 and/or a seat gasket (both of which will be discussed below) and obstructing flow through the sleeve flow bore 216.

In an alternative embodiment, a sleeve system like sleeve system 200 may comprise an expandable seat. Such an expandable seat may be constructed of, for example but not limited to, a low alloy steel such as AISI 4140 or 4130, and is generally configured to be biased radially outward so that if unrestricted radially, a diameter (e.g., outer/inner) of the seat 270 increases. In some embodiments, the expandable seat may be constructed from a generally serpentine length of AISI 4140. For example, the expandable seat may comprise a plurality of serpentine loops between upper and lower portions of the seat and continuing circumferentially to form the seat. In an embodiment, such an expandable seat may be covered by a protective sheath 272 (as will be discussed below) and/or may comprise a seat gasket.

Similar to the segmented seat 270 disclosed above with respect to FIGS. 2-4, in the embodiment of FIG. 5, one or more surfaces of the segmented seat 470 are covered by a protective sheath 472. Like the segmented seat 270 illustrated in FIG. 2A, the segmented seat 470 covers one or more of the chamfer 471 of the segmented seat 470, the inner bore 473 of the segmented seat 470, a lower face 475 of the segmented seat 470, or combinations thereof. In an alternative embodiment, a protective sheath may cover any one or more of the surfaces of a segmented seat 470, as will be appreciated by one of skill in the art viewing this disclosure. In an embodiment, the protective sheath 472 may form a continuous layer over those surfaces of the segmented seat 470 in fluid communication with the sleeve flow bore 416, may be formed in any suitable manner, and may be formed of a suitable material, for example, as disclosed above with respect to segmented seat 270 illustrated in FIGS. 2-4. In summary, all disclosure herein with respect to protective sheath 272 and segmented seat 270 are applicable to protective sheath 472 and segmented seat 470.

In an embodiment, the segmented seat 470 may further comprise a seat gasket that serves to seal against an obturator. In some embodiments, the seat gasket may be constructed of rubber. In such an embodiment and installation mode, the seat gasket may be substantially captured between the expandable seat and the lower end of the sleeve. In an embodiment, the protective sheath 472 may serve as such a gasket, for example, by engaging and/or sealing an obturator. In such an embodiment, the protective sheath 472 may have a variable thickness. For example, the surface(s) of the protective sheath 472 configured to engage the obturator (e.g., chamfer 471) may comprise a greater thickness than the one or more other surfaces of the protective sheath 472.

The seat 470 further comprises a seat shear pin aperture 478 that is radially aligned with and substantially coaxial with a similar piston shear pin aperture 480 formed in the piston 446. Together, the apertures 478, 480 receive a shear pin 482, thereby restricting movement of the seat 470 relative to the piston 446. Further, the piston 446 comprises a lug receptacle 484 for receiving a lug 486. In the installation mode of the sleeve system 400, the lug 486 is captured within the lug receptacle 484 between the seat 470 and the ported case 408. More specifically, the lug 486 extends into a substantially circumferential lug channel 488 formed in the ported case 408, thereby restricting movement of the piston 446 relative to the ported case 408. Accordingly, in the installation mode, with each of the shear pins 458, 482 and the lug 486 in place as described above, the piston 446, sleeve 460, and seat 470 are all substantially locked into position relative to the ported case 408 and relative to each other so that fluid communication between the sleeve flow bore 416 and the ports 444 is prevented.

The lower adapter 406 may be described as comprising an upper central bore 490 having an upper central bore diameter 492 and a seat catch bore 494 having a seat catch bore diameter 496 joined to the upper central bore 490. In this embodiment, the upper central bore diameter 492 is sized to closely fit an exterior of the seat 470, and, in an embodiment, is about equal to the diameter of the outer surface of the lower sleeve section 464. However, the seat catch bore diameter 496 is substantially larger than the upper central bore diameter 492, thereby allowing radial expansion of the expandable seat 470 when the expandable seat 470 enters the seat catch bore 494 as described in greater detail below.

Figure 6:
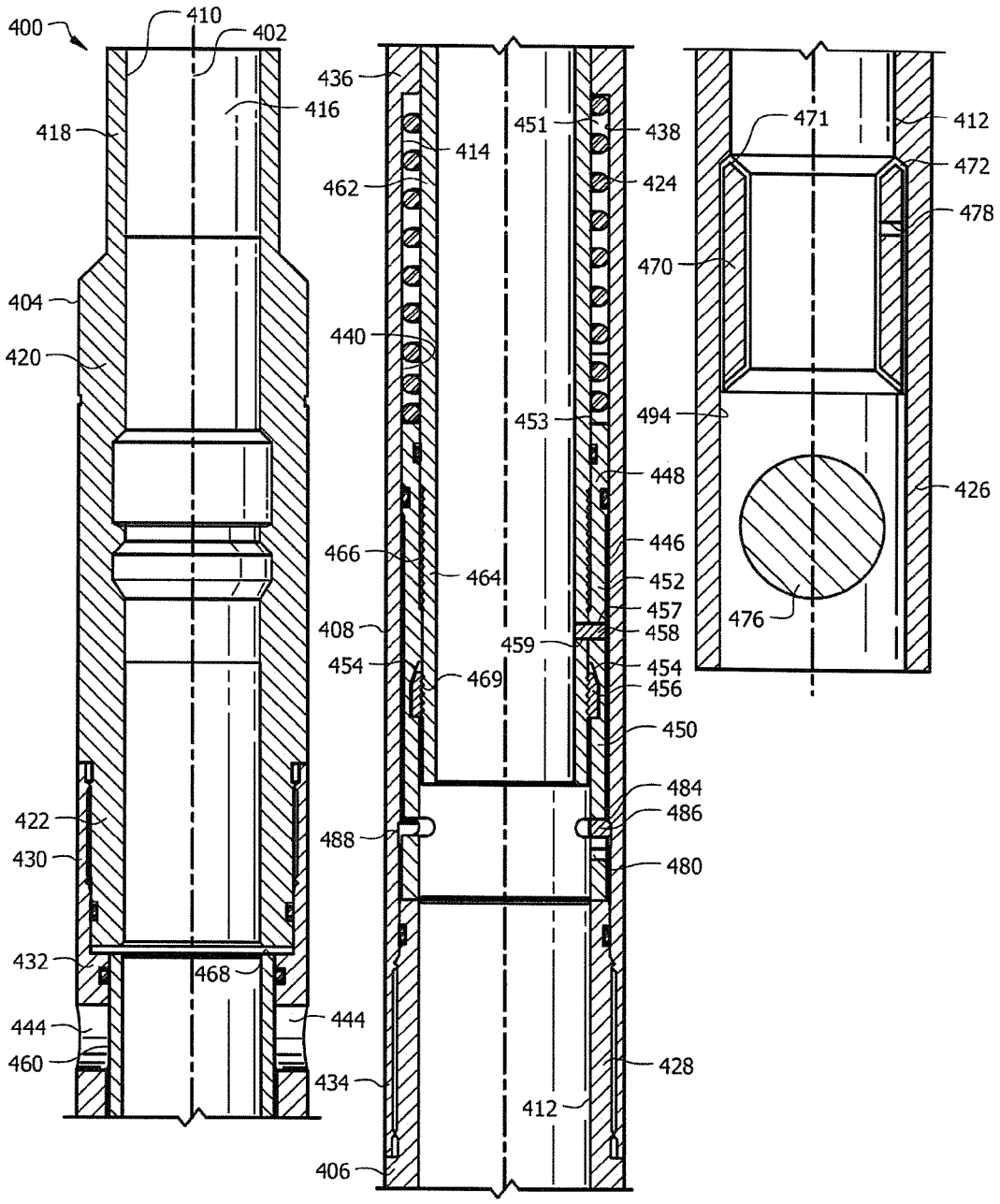
FIG. 6 is a cross-sectional view of the sleeve system of FIG. 5 showing the sleeve system in another stage of the installation mode.
Figure 7:
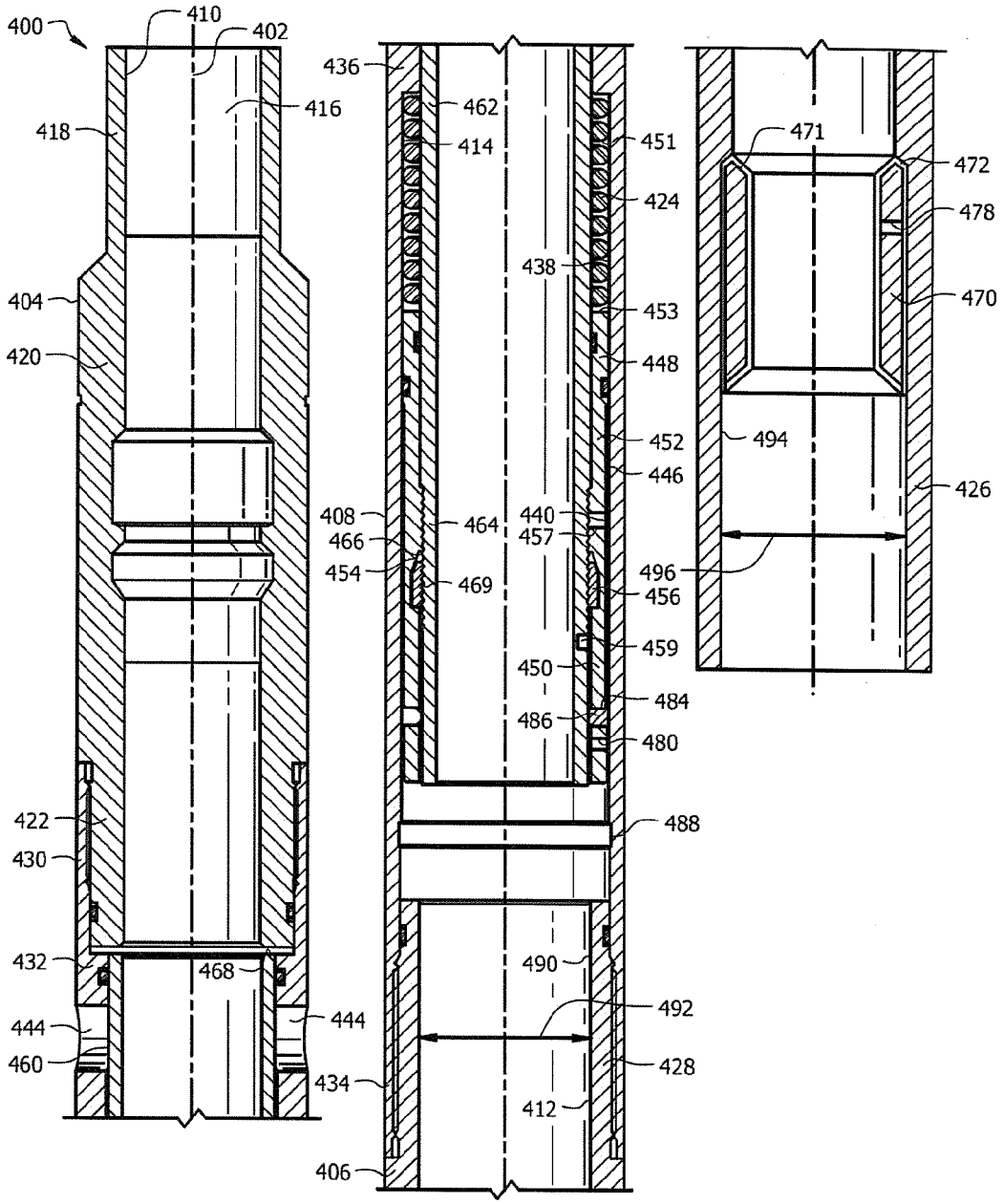
FIG. 7 is a cross-sectional view of the sleeve system of FIG. 5 showing the sleeve system in a delay mode.
Figure 8:
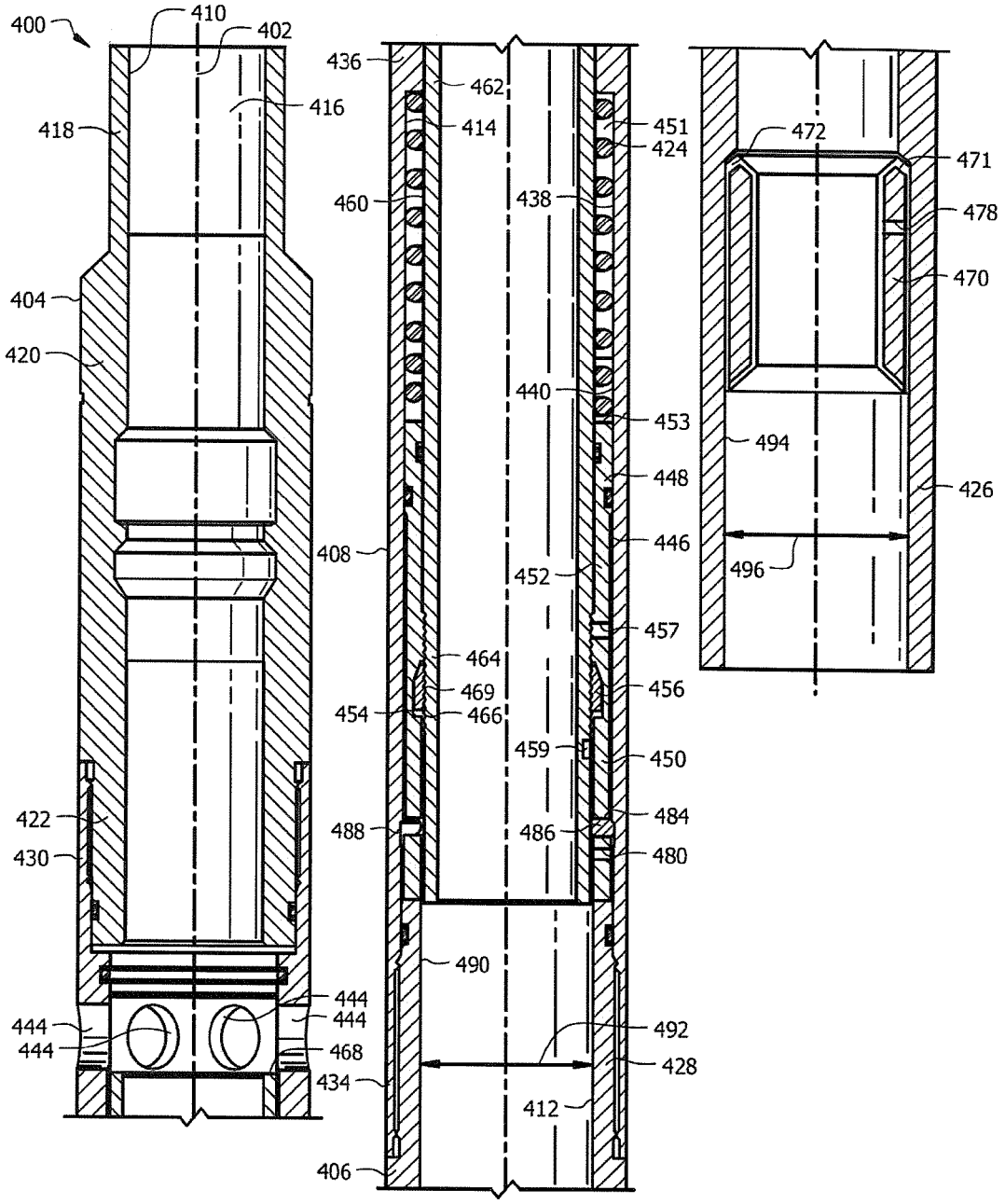
FIG. 8 is a cross-sectional view of the sleeve system of FIG. 5 showing the sleeve system in a fully open mode.

Referring now to FIGS. 5-8, a method of operating the sleeve system 400 is described below. Most generally, FIG. 5 shows the sleeve system 400 in an "installation mode" where sleeve 460 is at rest in position relative to the ported case 408 and so that the sleeve 460 prevents fluid communication between the sleeve flow bore 416 and the ports 444. It will be appreciated that sleeve 460 may be pressure balanced. FIG. 6 shows the sleeve system 400 in another stage of the installation mode where sleeve 460 is no longer restricted from moving relative to the ported case 408 by either the shear pin 482 or the lug 486, but remains restricted from such movement due to the presence of the shear pin 458. In the case where the sleeve 460 is pressure balanced, the pin 458 may primarily be used to prevent inadvertent movement of the sleeve 460 due to accidentally dropping the tool or other undesirable acts that cause the sleeve 460 to move due to undesired momentum forces. FIG. 7 shows the sleeve system 400 in a "delay mode" where movement of the sleeve 460 relative to the ported case 408 has not yet occurred but where such movement is contingent upon the occurrence of a selected wellbore condition. In this embodiment, the selected wellbore condition is the occurrence of a sufficient reduction of fluid pressure within the flow bore 416 following the achievement of the mode shown in FIG. 6. Finally, FIG. 8 shows the sleeve system 400 in a "fully open mode" where sleeve 460 no longer obstructs a fluid path between ports 444 and sleeve flow bore 416, but rather, a maximum fluid path is provided between ports 444 and the sleeve flow bore 416.

Referring now to FIG. 5, while the sleeve system 400 is in the installation mode, each of the piston 446, sleeve 460, protective sheath 472, and seat 470 are all restricted from movement along the central axis 402 at least because the shear pins 482, 458 lock the seat 470, piston 446, and sleeve 460 relative to the ported case 408. In this embodiment, the lug 486 further restricts movement of the piston 446 relative to the ported case 408 because the lug 486 is captured within the lug receptacle 484 of the piston 446 and between the seat 470 and the ported case 408. More specifically, the lug 486 is captured within the lug channel 488, thereby preventing movement of the piston 446 relative to the ported case 408. Further, in the installment mode, the spring 424 is partially compressed along the central axis 402, thereby biasing the piston 446 downward and away from the case shoulder 436. It will be appreciated that in alternative embodiments, the bias chamber 451 may be adequately sealed to allow containment of pressurized fluids that supply such biasing of the piston 446. For example, a nitrogen charge may be contained within such an alternative embodiment. It will be appreciated that the bias chamber 451, in alternative embodiments, may comprise one or both of a spring such as spring 424 and such a pressurized fluid.

Referring now to FIG. 6, the obturator 476 may be passed through a work string such as work string 112 until the obturator 476 substantially seals against the protective sheath 472 (as shown in FIG. 5), alternatively, the seat gasket in embodiments where a seat gasket is present. With the obturator 476 in place against the protective sheath 472 and/or seat gasket, the pressure within the sleeve flow bore 416 may be increased uphole of the obturator 476 until the obturator 476 transmits sufficient force through the protective sheath 472 and the seat 470 to cause the shear pin 482 to shear. Once the shear pin 482 has sheared, the obturator 476 drives the protective sheath 472 and the seat 470 downhole from their installation mode positions. Such downhole movement of the seat 470 uncovers the lug 486, thereby disabling the positional locking feature formally provided by the lug 486. Nonetheless, even though the piston 446 is no longer restricted from uphole movement by the protective sheath 472, the seat 470, and the lug 486, the piston remains locked in position by the spring force of the spring 424 and the shear pin 458. Accordingly, the sleeve system remains in a balanced or locked mode, albeit a different configuration or stage of the installation mode. It will be appreciated that the obturator 476, the protective sheath 472, and the seat 470 continue downward movement toward and interact with the seat catch bore 494 in substantially the same manner as the obturator 276, the protective sheath 272, and the seat 270 move toward and interact with the seat catch bore 304, as disclosed above with reference to FIGS. 2-4.

Referring now to FIG. 7, to initiate further transition from the installation mode to the delay mode, pressure within the flow bore 416 is increased until the piston 446 is forced upward and shears the shear pin 458. After such shearing of the shear pin 458, the piston 446 moves upward toward the case shoulder 436, thereby further compressing spring 424. With sufficient upward movement of the piston 446, the lower portion 450 of the piston 446 abuts the upper sleeve section 462. As the piston 446 travels to such abutment, the teeth 469 of c-ring 456 engage the teeth 466 of the lower sleeve section 464. The abutment between the lower portion 450 of the piston 446 and the upper sleeve section 446 prevents further upward movement of piston 446 relative to the sleeve 460. The engagement of teeth 469, 466 prevents any subsequent downward movement of the piston 446 relative to the sleeve 460. Accordingly, the piston 446 is locked in position relative to the sleeve 460 and the sleeve system 400 may be referred to as being in a delay mode.

While in the delay mode, the sleeve system 400 is configured to discontinue covering the ports 444 with the sleeve 460 in response to an adequate reduction in fluid pressure within the flow bore 416. For example, with the pressure within the flow bore 416 is adequately reduced, the spring force provided by spring 424 eventually overcomes the upward forced applied against the piston 446 that is generated by the fluid pressure within the flow bore 416. With continued reduction of pressure within the flow bore 416, the spring 424 forces the piston 446 downward. Because the piston 446 is now locked to the sleeve 460 via the c-ring 456, the sleeve is also forced downward. Such downward movement of the sleeve 460 uncovers the ports 444, thereby providing fluid communication between the flow bore 416 and the ports 444. When the piston 446 is returned to its position in abutment against the lower adapter 406, the sleeve system 400 is referred to as being in a fully open mode. The sleeve system 400 is shown in a fully open mode in FIG. 8.

In some embodiments, operating a wellbore servicing system such as wellbore servicing system 100 may comprise providing a first sleeve system (e.g., of the type of sleeve systems 200, 400) in a wellbore and providing a second sleeve system in the wellbore downhole of the first sleeve system. Next, wellbore servicing pumps and/or other equipment may be used to produce a fluid flow through the sleeve flow bores of the first and second sleeve systems. Subsequently, an obturator may be introduced into the fluid flow so that the obturator travels downhole and into engagement with the seat of the first sleeve system. When the obturator first contacts the seat of the first sleeve system, each of the first sleeve system and the second sleeve system are in one of the above-described installation modes so that there is not substantial fluid communication between the sleeve flow bores and an area external thereto (e.g., an annulus of the wellbore and/or an a perforation, fracture, or flowpath within the formation) through the ported cases of the sleeve systems. Accordingly, the fluid pressure may be increased to cause unlocking a restrictor of the first sleeve system as described in one of the above-described manners, thereby transitioning the first sleeve system from the installation mode to one of the above-described delayed modes.

In some embodiments, the fluid flow and pressure may be maintained so that the obturator passes through the first sleeve system in the above-described manner and subsequently engages the seat of the second sleeve system. The delayed mode of operation of the first sleeve system prevents fluid communication between the sleeve flow bore of the first sleeve and the annulus of the wellbore, thereby ensuring that no pressure loss attributable to such fluid communication prevents subsequent pressurization within the sleeve flow bore of the second sleeve system. Accordingly, the fluid pressure uphole of the obturator may again be increased as necessary to unlock a restrictor of the second sleeve system in one of the above-described manners. With both the first and second sleeve systems having been unlocked and in their respective delay modes, the delay modes of operation may be employed to thereafter provide and/or increase fluid communication between the sleeve flow bores and the proximate annulus of the wellbore and/or surrounding formation without adversely impacting an ability to unlock either of the first and second sleeve systems.

Further, it will be appreciated that one or more of the features of the sleeve systems may be configured to cause one or more relatively uphole located sleeve systems to have a longer delay periods before allowing substantial fluid communication between the sleeve flow bore and the annulus as compared to the delay period provided by one or more relatively downhole located sleeve systems. For example, the volume of the fluid chamber 268, the amount of and/or type of fluid placed within fluid chamber 268, the fluid metering device 291, and/or other features of the first sleeve system may be chosen differently and/or in different combinations than the related components of the second sleeve system in order to adequately delay provision of the above-described fluid communication via the first sleeve system until the second sleeve system is unlocked and/or otherwise transitioned into a delay mode of operation, until the provision of fluid communication to the annulus and/or the formation via the second sleeve system, and/or until a predetermined amount of time after the provision of fluid communication via the second sleeve system. In some embodiments, such first and second sleeve systems may be configured to allow substantially simultaneous and/or overlapping occurrences of providing substantial fluid communication (e.g., substantial fluid communication and/or achievement of the above-described fully open mode). However, in other embodiments, the second sleeve system may provide such fluid communication prior to such fluid communication being provided by the first sleeve system.

Referring now to FIG. 1, one or more methods of servicing wellbore 114 using wellbore servicing system 100 are described. In some cases, wellbore servicing system 100 may be used to selectively treat selected one or more of zone 150, first, second, third, fourth, and fifth zones 150*a*-150*e* by selectively providing fluid communication via (e.g., opening) one or more the sleeve systems (e.g., sleeve systems 200 and 200*a*-200*e*) associated with a given zone. More specifically, by employing the above-described method of operating individual sleeve systems such as sleeve systems 200 and/or 400, any one of the zones 150, 150*a*-150*e* may be treated using the respective associated sleeve systems 200 and 200*a*-200*e*. It will be appreciated that zones 150, 150*a*-150*e* may be isolated from one another, for example, via swell packers, mechanical packers, sand plugs, sealant compositions (e.g., cement), or combinations thereof. In an embodiments where the operation of a first and second sleeve system is discussed, it should be appreciated that a plurality of sleeve systems (e.g., a third, fourth, fifth, etc. sleeve system) may be similarly operated to selectively treat a plurality of zones (e.g., a third, fourth, fifth, etc. treatment zone), for example, as discussed below with respect to FIG. 1.

In a first embodiment, a method of performing a wellbore servicing operation by individually servicing a plurality of zones of a subterranean formation with a plurality of associated sleeve systems is provided. In such an embodiment, sleeve systems 200 and 200*a*-200*e* may be configured substantially similar to sleeve system 200 described above. Sleeve systems 200 and 200*a*-200*e* may be provided with seats configured to interact with an obturator of a first configuration and/or size (e.g., a single ball and/or multiple balls of the same size and configuration). The sleeve systems 200 and 200*a*-200*e* comprise the fluid metering delay system and each of the various sleeve systems may be configured with a fluid metering device chosen to provide fluid communication via that particular sleeve system within a selectable passage of time after being transitioned from installation mode to delay mode. Each sleeve system may be configured to transition from the delay mode to the fully open mode and thereby provide fluid communication in an amount of time equal to the sum of the amount of time necessary to transition all sleeves located further downhole from that sleeve system from installation mode to delay mode (for example, by engaging an obturator as described above) and perform a desired servicing operation with respect to the zone(s) associated with that sleeve system(s); in addition, an operator may choose to build in an extra amount of time as a "safety margin" (e.g., to ensure the completion of such operations). In addition, in an embodiment where successive zones will be treated, it may be necessary to allow additional time to restrict fluid communication to a previously treated zone (e.g., upon the completion of servicing operations with respect to that zone). For example, it may be necessary to allow time for perform a "screenout" with respect to a particular zone, as is discussed below. For example, where an estimated time of travel of an obturator between adjacent sleeve systems is about 10 minutes, where an estimated time to perform a servicing operation is about 1 hour and 40 minutes, and where the operator wishes to have an additional 10 minutes as a safety margin, each sleeve system might be configured to transition from delay mode to fully open mode about 2 hours after the sleeve system immediately downhole from that sleeve system. Referring again to FIG. 1, in such an example, the furthest downhole sleeve system (200*a*) might be configured to transition from delay mode to fully open mode shortly after being transitioned from installation mode to delay mode (e.g., immediately, within about 30 seconds, within about 1 minute, or within about 5 minutes); the second furthest downhole sleeve system (200*b*) might be configured to transition to fully open mode at about 2 hours, the third most downhole sleeve system (200*c*) might be configured to transition to fully open mode at about 4 hours, the fourth most downhole sleeve system (200*d*) might be configured to transition to fully open mode at about 6 hours, the fifth most downhole sleeve system (200*e*) might be configured to transition to fully open mode at about 8 hours, and the sixth most downhole sleeve system might be transitioned to fully open mode at about 10 hours. In various alternative embodiments, any one or more of the sleeve systems (e.g., 200 and 200*a*-200*e*) may be configured to open within a desired amount of time. For example, a given sleeve may be configured to open within about 1 second after being transitioned from installation mode to delay mode, alternatively, within about 30 seconds, 1 minute, 5 minutes, 15 minutes, 30 minutes, 1 hour, 2 hours, 3 hours, 4 hours, 6 hours, 8 hours, 10 hours, 12 hours, 14 hours, 16 hours, 18 hours, 20 hours, 24 hours, or any amount of time to achieve a given treatment profile, as will be discussed herein below.

In an alternative embodiment, sleeve systems 200 and 200*b*-200*e* are configured substantially similar to sleeve system 200 described above, and sleeve system 200*a* is configured substantially similar to sleeve system 400 described above. Sleeve systems 200 and 200*a*-200*e* may be provided with seats configured to interact with an obturator of a first configuration and/or size. The sleeve systems 200 and 200*b*-200*e* comprise the fluid metering delay system and each of the various sleeve systems may be configured with a fluid metering device chosen to provide fluid communication via that particular sleeve system within a selectable amount of time after being transitioned from installation mode to delay mode, as described above. The furthest downhole sleeve system (200*a*) may be configured to transition from delay mode to fully open mode upon an adequate reduction in fluid pressure within the flow bore of that sleeve system, as described above with reference to sleeve system 400. In such an alternative embodiment, the furthest downhole sleeve system (200*a*) may be transitioned from delay mode to fully open mode shortly after being transitioned to delay mode. Sleeve systems being further uphole may be transitioned from delay mode to fully open mode at selectable passage of time thereafter, as described above.

In other words, in either embodiment, the fluid metering devices may be selected so that no sleeve system will provide fluid communication between its respective flow bore and ports until each of the sleeve systems further downhole from that particular sleeve system has achieved transition from the delayed mode to the fully open mode and/or until a predetermined amount of time has passed. Such a configuration may be employed where it is desirable to treat multiple zones (e.g., zones 150 and 150*a*-150*e*) individually and to activate the associated sleeve systems using a single obturator, thereby avoiding the need to introduce and remove multiple obturators through a work string such as work string 112. In addition, because a single size and/or configuration of obturator may be employed with respect to multiple (e.g., all) sleeve systems a common work string, the size of the flowpath (e.g., the diameter of a flowbore) through that work string may be more consistent, eliminating or decreasing the restrictions to fluid movement through the work string. As such, there may be few deviations with respect to flowrate of a fluid.

In either of these embodiments, a method of performing a wellbore servicing operation may comprise providing a work string comprising a plurality of sleeve systems in a configuration as described above and positioning the work string within the wellbore such that one or more of the plurality of sleeve systems is positioned proximate and/or substantially adjacent to one or more of the zones (e.g., deviated zones) to be serviced. The zones may be isolated, for example, by actuating one or more packers or similar isolation devices.

Next, when fluid communication is to be provided via sleeve systems 200 and 200*a*-200*e*, an obturator like obturator 276 configured and/or sized to interact with the seats of the sleeve systems is introduced into and passed through the work string 112 until the obturator 276 reaches the relatively furthest uphole sleeve system 200 and engages a seat like seat 270 of that sleeve system. Continued pumping may increase the pressure applied against the seat 270 causing the sleeve system to transition from installation mode to delay mode and the obturator to pass through the sleeve system, as described above. The obturator may then continue to move through the work string to similarly engage and transition sleeve systems 200*a*-200*e* to delay mode. When all of the sleeve systems 200 and 200*a*-200*e* have been transitioned to delay mode, the sleeve systems may be transitioned from delay mode to fully open in the order in which the zone or zones associated with a sleeve system are to be serviced. In an embodiment, the zones may be serviced beginning with the relatively furthest downhole zone (150*a*) and working toward progressively lesser downhole zones (e.g., 150*b*, 150*c*, 150*d*, 150*e*, then 150). Servicing a particular zone is accomplished by transitioning the sleeve system associated with that zone to fully open mode and communicating a servicing fluid to that zone via the ports of the sleeve system. In an embodiment where sleeve systems 200 and 200*a*-200*e* of FIG. 1 are configured substantially similar to sleeve system 200 of FIG. 2, transitioning sleeve system 200*a* (which is associated with zone 150*a*) to fully open mode may be accomplished by waiting for the preset amount of time following unlocking the sleeve system 200*a* while the fluid metering system allows the sleeve system to open, as described above. With the sleeve system 200*a* fully open, a servicing fluid may be communicated to the associated zone (150*a*). In an embodiment where sleeve systems 200 and 200*b*-200*e* are configured substantially similar to sleeve system 200 and sleeve system 200*a* is configured substantially similar to sleeve system 400, transitioning sleeve system 200*a* to fully open mode may be accomplished by allowing a reduction in the pressure within the flow bore of the sleeve system, as described above.

One of skill in the art will appreciate that the servicing fluid communicated to the zone may be selected dependent upon the servicing operation to be performed. Nonlimiting examples of such servicing fluids include a fracturing fluid, a hydrajetting or perforating fluid, an acidizing, an injection fluid, a fluid loss fluid, a sealant composition, or the like.

As may be appreciated by one of skill in the art viewing this disclosure, when a zone has been serviced, it may be desirable to restrict fluid communication with that zone, for example, so that a servicing fluid may be communicated to another zone. In an embodiment, when the servicing operation has been completed with respect to the relatively furthest downhole zone (150*a*), an operator may restrict fluid communication with zone 150*a* (e.g., via sleeve system 200*a*) by intentionally causing a "screenout" or sand-plug. As will be appreciated by one of skill in the art viewing this disclosure, a "screenout" or "screening out" refers to a condition where solid and/or particulate material carried within a servicing fluid creates a "bridge" that restricts fluid flow through a flowpath. By screening out the flow paths to a zone, fluid communication to the zone may be restricted so that fluid may be directed to one or more other zones.

When fluid communication has been restricted, the servicing operation may proceed with respect to additional zones (e.g., 150*b*-150*e* and 150) and the associated sleeve systems (e.g., 200*b*-200*e* and 200). As disclosed above, additional sleeve systems will transition to fully open mode at preset time intervals following transitioning from installation mode to delay mode, thereby providing fluid communication with the associated zone and allowing the zone to be serviced. Following completion of servicing a given zone, fluid communication with that zone may be restricted, as disclosed above. In an embodiment, when the servicing operation has been completed with respect to all zones, the solid and/or particulate material employed to restrict fluid communication with one or more of the zones may be removed, for example, to allow the flow of wellbore production fluid into the flow bores of the of the open sleeve systems via the ports of the open sleeve systems.

In an alternative embodiment, employing the systems and/or methods disclosed herein, various treatment zones may be treated and/or serviced in any suitable sequence, that is, a given treatment profile. Such a treatment profile may be determined and a plurality of sleeve systems like sleeve system 200 may be configured (e.g., via suitable time delay mechanisms, as disclosed herein) to achieve that particular profile. For example, in an embodiment where an operator desires to treat three zones of a formation beginning with the lowermost zone, followed by the uppermost zone, followed by the intermediate zone, three sleeve systems of the type disclosed herein may be positioned proximate to each zone. The first sleeve system (e.g., proximate to the lowermost zone) may be configured to open first, the third sleeve system (e.g., proximate to the uppermost zone) may be configured to open second (e.g., allowing enough time to complete the servicing operation with respect to the first zone and obstruct fluid communication via the first sleeve system) and the second sleeve system (e.g., proximate to the intermediate zone) may be configured to open last (e.g., allowing enough time to complete the servicing operation with respect to the first and second zones and obstruct fluid communication via the first and second sleeve systems).

While the following discussion is related to actuating two groups of sleeves (each group having three sleeves), it should be understood that such description is non-limiting and that any suitable number and/or grouping of sleeves may be actuated in corresponding treatment stages. In a second embodiment where treatment of zones 150*a*, 150*b*, and 150*c* is desired without treatment of zones 150*d*, 150*e* and 150, sleeve systems 200*a*-200*e* are configured substantially similar to sleeve system 200 described above. In such an embodiment, sleeve systems 200*a*, 200*b*, and 200*c* may be provided with seats configured to interact with an obturator of a first configuration and/or size while sleeve systems 200*d*, 200*e*, and 200 are configured not to interact with the obturator having the first configuration. Accordingly, sleeve systems 200*a*, 200*b*, and 200*c* may be transitioned from installation mode to delay mode by passing the obturator having a first configuration through the uphole sleeve systems 200, 200*e*, and 200*d* and into successive engagement with sleeve systems 200*c*, 200*b*, and 200*a*. Since the sleeve systems 200*a*-200*c* comprise the fluid metering delay system, the various sleeve systems may be configured with fluid metering devices chosen to provide a controlled and/or relatively slower opening of the sleeve systems. For example, the fluid metering devices may be selected so that none of the sleeve systems 200*a*-200*c* actually provide fluid communication between their respective flow bores and ports prior to each of the sleeve systems 200*a*-200*c* having achieved transition from the installation mode to the delayed mode. In other words, the delay systems may be configured to ensure that each of the sleeve systems 200*a*-200*c* has been unlocked by the obturator prior to such fluid communication.

To accomplish the above-described treatment of zones 150*a*, 150*b*, and 150*c*, it will be appreciated that to prevent loss of fluid and/or fluid pressure through ports of sleeve systems 200*c*, 200*b*, each of sleeve systems 200*c*, 200*b* may be provided with a fluid metering device that delays such loss until the obturator has unlocked the sleeve system 200*a*. It will further be appreciated that individual sleeve systems may be configured to provide relatively longer delays (e.g., the time from when a sleeve system is unlocked to the time that the sleeve system allows fluid flow through its ports) in response to the location of the sleeve system being located relatively further uphole from a final sleeve system that must be unlocked during the operation (e.g., in this case, sleeve system 200*a*). Accordingly, in some embodiments, a sleeve system 200*c* may be configured to provide a greater delay than the delay provided by sleeve system 200*b*. For example, in some embodiments where an estimated time of travel of an obturator from sleeve system 200*c* to sleeve system 200*b* is about 10 minutes and an estimated time of travel from sleeve system 200*b* to sleeve system 200*a* is also about 10 minutes, the sleeve system 200*c* may be provided with a delay of at least about 20 minutes. The 20 minute delay may ensure that the obturator can both reach and unlock the sleeve systems 200*b*, 200*a* prior to any fluid and/or fluid pressure being lost through the ports of sleeve system 200*c*.

Alternatively, in some embodiments, sleeve systems 200*c*, 200*b* may each be configured to provide the same delay so long as the delay of both are sufficient to prevent the above-described fluid and/or fluid pressure loss from the sleeve systems 200*c*, 200*b* prior to the obturator unlocking the sleeve system 200*a*. For example, in an embodiment where an estimated time of travel of an obturator from sleeve system 200*c* to sleeve system 200*b* is about 10 minutes and an estimated time of travel from sleeve system 200*b* to sleeve system 200*a* is also about 10 minutes, the sleeve systems 200*c*, 200*b* may each be provided with a delay of at least about 20 minutes. Accordingly, using any of the above-described methods, all three of the sleeve systems 200*a*-200*c* may be unlocked and transitioned into fully open mode with a single trip through the work string 112 of a single obturator and without unlocking the sleeve systems 200*d*, 200*e*, and 200 that are located uphole of the sleeve system 200*c*.

Next, if sleeve systems 200*d*, 200*e*, and 200 are to be opened, an obturator having a second configuration and/or size may be passed through sleeve systems 200*d*, 200*e*, and 200 in a similar manner to that described above to selectively open the remaining sleeve systems 200*d*, 200*e*, and 200. Of course, this is accomplished by providing 200*d*, 200*e*, and 200 with seats configured to interact with the obturator having the second configuration.

In alternative embodiments, sleeve systems such as 200*a*, 200*b*, and 200*c* may all be associated with a single zone of a wellbore and may all be provided with seats configured to interact with an obturator of a first configuration and/or size while sleeve systems such as 200*d*, 200*e*, and 200 may not be associated with the above-mentioned single zone and are configured not to interact with the obturator having the first configuration. Accordingly, sleeve systems such as 200*a*, 200*b*, and 200*c* may be transitioned from an installation mode to a delay mode by passing the obturator having a first configuration through the uphole sleeve systems 200, 200*e*, and 200*d* and into successive engagement with sleeve systems 200*c*, 200*b*, and 200*a*. In this way, the single obturator having the first configuration may be used to unlock and/or activate multiple sleeve systems (e.g., 200*c*, 200*b*, and 200*a*) within a selected single zone after having selectively passed through other uphole and/or non-selected sleeve systems (e.g., 200*d*, 200*e*, and 200).

An alternative embodiment of a method of servicing a wellbore may be substantially the same as the previous examples, but instead, using at least one sleeve system substantially similar to sleeve system 400. It will be appreciated that while using the sleeve systems substantially similar to sleeve system 400 in place of the sleeve systems substantially similar to sleeve system 200, a primary difference in the method is that fluid flow between related fluid flow bores and ports is not achieved amongst the three sleeve systems being transitioned from an installation mode to a fully open mode until pressure within the fluid flow bores is adequately reduced. Only after such reduction in pressure will the springs of the sleeve systems substantially similar to sleeve system 400 force the piston and the sleeves downward to provide the desired fully open mode.

Regardless of which type of the above-disclosed sleeve systems 200, 400 are used, it will be appreciated that use of either type may be performed according to a method described below. A method of servicing a wellbore may comprise providing a first sleeve system in a wellbore and also providing a second sleeve system downhole of the first sleeve system. Subsequently, a first obturator may be passed through at least a portion of the first sleeve system to unlock a restrictor of the first sleeve, thereby transitioning the first sleeve from an installation mode of operation to a delayed mode of operation. Next, the obturator may travel downhole from the first sleeve system to pass through at least a portion of the second sleeve system to unlock a restrictor of the second sleeve system. In some embodiments, the unlocking of the restrictor of the second sleeve may occur prior to loss of fluid and/or fluid pressure through ports of the first sleeve system.

In either of the above-described methods of servicing a wellbore, the methods may be continued by flowing wellbore servicing fluids from the fluid flow bores of the open sleeve systems out through the ports of the open sleeve systems. Alternatively and/or in combination with such outward flow of wellbore servicing fluids, wellbore production fluids may be flowed into the flow bores of the open sleeve systems via the ports of the open sleeve systems.

ADDITIONAL DISCLOSURE

The following are nonlimiting, specific embodiments in accordance with the present disclosure:

Embodiment A

A wellbore servicing system, comprising:

a tubular string;

a first sleeve system incorporated within the tubular string, the first sleeve system comprising a first sliding sleeve at least partially carried within a first ported case, the first sleeve system being selectively restricted from movement relative to the first ported case by a first restrictor while the first restrictor is enabled, and a first delay system configured to selectively restrict movement of the first sliding sleeve relative to the first ported case while the first restrictor is disabled;

a second sleeve system incorporated within the tubular string, the second sleeve system comprising a second sliding sleeve at least partially carried within a second ported case, the second sleeve system being selectively restricted from movement relative to the second ported case by a second restrictor while the second restrictor is enabled, and a second delay system configured to selectively restrict movement of the second sliding sleeve relative to the second ported case while the second restrictor is disabled; and a first wellbore isolator positioned circumferentially about the tubular string between the first sleeve system and the second sleeve system.

Embodiment B

The wellbore servicing system according to Embodiment A, wherein the first wellbore isolator comprises a packer, cement, or combinations thereof.

Embodiment C

The wellbore servicing system according to Embodiment B, wherein the packer comprises a swellable packer.

Embodiment D

The wellbore servicing system according to one of Embodiments A through C, wherein the first delay system comprises:

a fluid chamber formed between the first ported case and the first sliding sleeve; and a fluid metering device in fluid communication with the fluid chamber.

Embodiment E

The wellbore servicing system according to Embodiment D, wherein fluid flow through the fluid metering device is prevented while the first restrictor is enabled.

Embodiment F

The wellbore servicing system according to Embodiment E, wherein the first restrictor comprises a shear pin, and wherein fluid flow through the metering device is allowed subsequent a shearing of the shear pin.

Embodiment G

The wellbore servicing system according to Embodiment F, wherein the shear pin selectively restricts movement of an expandable seat of the first sleeve system.

Embodiment H

The wellbore servicing system according to Embodiment G, wherein the shear pin is received within each of a seat support of the first sleeve system and a lower adapter of the first sleeve system.

Embodiment I

The wellbore servicing system according to one of Embodiments A through H, wherein the first delay system comprises:

a piston carried at least partially within the first ported case; and a low pressure chamber formed between the piston and the first ported case.

Embodiment J

The wellbore servicing system according to one of Embodiments A through I, further comprising:

a third sleeve system incorporated within the tubular string between the first sleeve system and the wellbore isolator, the third sleeve system comprising a third sliding sleeve at least partially carried within a third ported case, the third sleeve system being selectively restricted from movement relative to the third ported case by a third restrictor while the third restrictor is enabled, and a third delay system configured to selectively restrict movement of the third sliding sleeve relative to the third ported case while the third restrictor is disabled; and a fourth sleeve system incorporated within the tubular string between the second sleeve system and the wellbore isolator, the fourth sleeve system comprising a fourth sliding sleeve at least partially carried within a fourth ported case, the fourth sleeve system being selectively restricted from movement relative to the fourth ported case by a fourth restrictor while the fourth restrictor is enabled, and a fourth delay system configured to selectively restrict movement of the fourth sliding sleeve relative to the fourth ported case while the fourth restrictor is disabled.

Embodiment K

The wellbore servicing system according to Embodiment J, further comprising:

a first obturator configured to disable the first restrictor and the third restrictor; and a second obturator configured to disable the second restrictor and the fourth restrictor.

Embodiment L

The wellbore servicing system according to Embodiment J, further comprising a second wellbore isolator positioned circumferentially about the tubular string between the first sleeve system and the third sleeve system.

Embodiment M

The wellbore servicing system according to Embodiment L, further comprising a third wellbore isolator positioned circumferentially about the tubular string between the second sleeve system and the fourth sleeve system.

Embodiment N

The wellbore servicing system according to one of Embodiments A through M, wherein the first sleeve system comprises:

a first segmented seat, the first segmented seat being radially divided into a plurality of segments and movable relative to the first ported case between a first position in which the first seat restricts movement of the first sliding sleeve relative to the first ported case and a second position in which the first seat does not restrict movement of the first sliding sleeve relative to the first ported case; and a first sheath forming a continuous layer that covers one or more surfaces of the first segmented seat.

Embodiment O

The wellbore servicing system according to Embodiment N, wherein the second sleeve system comprises:

a second segmented seat, the second segmented seat being radially divided into a plurality of segments and movable relative to the second ported case between a first position in which the second seat restricts movement of the second sliding sleeve relative to the second ported case and a second position in which the second seat does not restrict movement of the second sliding sleeve relative to the second ported case; and a second sheath forming a continuous layer that covers one or more surfaces of the second segmented seat.

Embodiment P

A method of servicing a wellbore, comprising:

positioning a tubular string within the wellbore, the tubular string comprising;

a first sleeve system, wherein the first sleeve system is positioned within the wellbore proximate to a first zone of the wellbore, the first sleeve system being initially configured in an installation mode where fluid flow between a flow bore of the first sleeve system and a port of the first sleeve system is restricted;

a second sleeve system, wherein the second sleeve system is positioned within the wellbore proximate to a second zone of the wellbore, the second sleeve system being initially configured in an installation mode where fluid flow between a flow bore of the second sleeve system and a port of the second sleeve system is restricted;

isolating the first zone of the wellbore from the second zone of the wellbore; and passing a first obturator through at least a portion of the first sleeve system, thereby unlocking a first restrictor of the first sleeve system and thereby transitioning the first sleeve system to a delayed mode;

allowing the first sleeve system to transition from the delayed mode to a fully open mode; and communicating a fluid to the first zone of the wellbore via one or more ports of the first sleeve system.

Embodiment Q

The method of Embodiment P, further comprising:

passing a second obturator through at least a portion of the second sleeve system, thereby unlocking a second restrictor of the second sleeve system and thereby transitioning the second sleeve system to a delayed mode;

allowing the second sleeve system to transition from the delayed mode to a fully open mode; and communicating a fluid to the second zone of the wellbore via one or more ports of the second sleeve system.

Embodiment R

The method of Embodiment Q, wherein the tubular string further comprises:

a third sleeve system, wherein the third sleeve system is positioned within the wellbore proximate to the first zone of the wellbore, the third sleeve system being initially configured in an installation mode where fluid flow between a flow bore of the third sleeve system and a port of the third sleeve system is restricted.

Embodiment S

The method of Embodiment R, wherein the first obturator also passes through the third sleeve system, thereby unlocking a third restrictor of the third sleeve system and thereby transitioning the third sleeve system to a delayed mode.

Embodiment T

The method of Embodiment S, further comprising:

before communicating a fluid to the first zone of the wellbore via the one or more ports of the first sleeve system, allowing the third sleeve system to transition from the delayed mode to a fully open mode; and substantially simultaneously with communicating the fluid to the first zone of the wellbore via the one or more ports of the first sleeve system, communicating the fluid to the first zone of the wellbore via one or more ports of the third sleeve system.

Embodiment U

The method of one of Embodiments P through T, wherein isolating the first zone of the wellbore from the second zone of the wellbore comprises:

placing a cementitious slurry within an annular space surrounding a portion of the tubular string between the first sleeve system and the second sleeve system; and allowing the cementitious slurry to set.

Embodiment V

The method of one of Embodiments P through T, wherein isolating the first zone of the wellbore from the second zone of the wellbore comprises:

placing a swellable packer about the tubular string between the first sleeve system and the second sleeve system;

contacting a fluid with the swellable packer; and allowing the swellable packer to swell to contact a wall of the wellbore.

Embodiment W

A method of servicing a wellbore, comprising:

positioning a tubular string within the wellbore, the tubular string comprising a first sleeve system, wherein the first sleeve system is positioned within the wellbore proximate to a first zone of the wellbore, the first sleeve system being initially configured in an installation mode where fluid flow between a flow bore of the first sleeve system and a port of the first sleeve system is restricted;

a second sleeve system, wherein the second sleeve system is positioned within the wellbore proximate to the first zone of the wellbore, the second sleeve system being initially configured in an installation mode where fluid flow between a flow bore of the second sleeve system and a port of the second sleeve system is restricted;

a third sleeve system, wherein the third sleeve system is positioned within the wellbore proximate to a second zone of the wellbore, the third sleeve system being initially configured in an installation mode where fluid flow between a flow bore of the third sleeve system and a port of the third sleeve system is restricted;

a fourth sleeve system, wherein the fourth sleeve system is positioned within the wellbore proximate to the second zone of the wellbore, the fourth sleeve system being initially configured in an installation mode where fluid flow between a flow bore of the fourth sleeve system and a port of the fourth sleeve system is restricted;

isolating the first zone of the wellbore from the second zone of the wellbore;

passing a first obturator through at least a portion of the first sleeve system and at least a portion of the second sleeve system, thereby unlocking a first restrictor of the first sleeve system and a second restrictor of the second sleeve system and thereby transitioning the first sleeve system and the second sleeve system to a delayed mode;

allowing the first sleeve system and the second sleeve system to transition from the delayed mode to a fully open mode;

communicating a fluid to the first zone of the wellbore via one or more ports of the first sleeve system and one or more ports of the second sleeve system while not communicating a fluid to the second zone;

passing a second obturator through at least a portion of the third sleeve system and at least a portion of the fourth sleeve system, thereby unlocking a third restrictor of the third sleeve system and a fourth restrictor of the fourth sleeve system and thereby transitioning the third sleeve system and the fourth sleeve system to a delayed mode;

allowing the third sleeve system and the fourth sleeve system to transition from the delayed mode to a fully open mode; and communicating a fluid to the second zone of the wellbore via one or more ports of the third sleeve system and one or more ports of the fourth sleeve system.

Embodiment X

The method of Embodiment W, wherein isolating the first zone of the wellbore from the second zone of the wellbore comprises:

placing a cementitious slurry within an annular space surrounding a portion of the tubular string between the first sleeve system and the third sleeve system; and allowing the cementitious slurry to set.

Embodiment Y

The method of Embodiment W, wherein isolating the first zone of the wellbore from the second zone of the wellbore comprises:

placing a swellable packer about the tubular string between the first sleeve system and the third sleeve system;

contacting a fluid with the swellable packer; and allowing the swellable packer to swell to contact a wall of the wellbore.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A segmented seat for placement in subterranean wellbore equipment for engagement with an obturator, the segmented seat comprising:

an annular body that is radially divided into a plurality of separate segments, the annular body defining a central bore extending axially therethrough, a generally cylindrical outer wall, and an end wall;

an annular seat formed on the end wall and extending about the central bore of the annular body, the annular seat being of a size and shape to engage the obturator;

at least one recess formed into each of the segments and offset from the outer wall of the annular body so that at least a portion of the annular body is located radially between the outer wall and the recess; and a non-metallic material disposed within the recess and joining adjacent segments together.

2. The segmented seat according to claim 1, wherein the at least one recess comprises a slot.

3. The segmented seat according to claim 2, wherein the slot is endless and extends around the body.

4. The segmented seat according to claim 2, wherein the slot is in the end wall.

5. The segmented seat according to claim 1, wherein the recess comprises a chamber formed in the body segments.

6. The segmented seat according to claim 5, wherein the annular body further defines an inner wall; and wherein the chamber is endless and includes sidewalls that are offset from the outer wall and the inner wall of the annular body, respectively, such that the chamber extends around the interior of the annular body.

7. The segmented seat according to claim 1, wherein an end wall opposite the end wall containing the annular seat comprises notches.

8. The segmented seat according to claim 1, wherein the non-metallic material comprises elastomer.

9. The segmented seat according to claim 1, wherein the non-metallic material comprises polymer.

10. A downhole wellbore tool for engagement by an obturator comprising:

a tool for connection to a tubing string;

a passageway extending axially within the tool and being in fluid communication with the tubing string, the passageway comprising:

an upper central bore; and a catch bore positioned below the upper central bore; and a segmented seat positioned in the upper central bore of the tool passageway, the segmented seat comprising:

an annular body that is radially divided into a plurality of separate segments, the annular body defining an internal passage extending axially therethrough, a generally cylindrical outer wall, and an end wall;

an annular seat formed on the end wall and extending about the internal passage of the annular body, the annular seat being of a size and shape to engage the obturator in order to restrict flow through the internal passage;

at least one recess formed into each of the segments and offset from the outer wall of the annular body so that at least a portion of the annular body is located radially between the outer wall and the recess; and a non-metallic material disposed within the recess and joining adjacent segments together.

11. The downhole wellbore tool according to claim 10, additionally comprising a sleeve defining an opening extending axially therethrough;

wherein the segmented seat is mounted within the opening of the sleeve; and wherein, when the obturator is engaged on the annular seat, flow is restricted through the opening in the sleeve and through the internal passage of the annular body.

12. The downhole wellbore tool according to claim 11, wherein the sleeve is positioned in the upper central bore and adapted to slide axially therethrough.

13. The downhole wellbore tool according to claim 11, wherein the catch bore contains an uphole facing shoulder for engagement with the segmented seat in order to limit and/or restrict rotational movement of the segmented seat.

14. A method of using an obturator to move a downhole wellbore tool between a first operating state and a second operating state, the method comprising:

connecting the well bore tool to a tubing string, the well bore tool comprising:

a tool for connection to a tubing string;

a passageway extending axially within the tool and being in fluid communication with the tubing string, the passageway comprising:

an upper central bore; and a catch bore positioned below the upper central bore; and a segmented seat positioned in the tool passageway, the segmented seat comprising:

an annular body that is radially divided into a plurality of separate segments, the annular body defining an internal passage extending axially therethrough, a generally cylindrical outer wall, and an end wall;

an annular seat formed on the end wall and extending about the internal passage of the annular body, the annular seat being of a size and shape to engage the obturator in order to restrict flow through the internal passage; and at least one recess formed into each of the segments and offset from the outer wall of the annular body so that at least a portion of the annular body is located radially between the outer wall and the recess, wherein a non-metallic material is disposed within the recess and joins adjacent ones of the separate segments together;

positioning the wellbore tool at a downhole location within a wellbore that traverses a subterranean formation;

placing the wellbore tool in the first operating state, in which a fluid is permitted to pass through the internal passage of the annular body, the segmented seat being disposed within the upper central bore when the wellbore tool is in the first operating state;

placing the wellbore tool in the second operating state, in which the fluid is restricted from passing through the internal passage of the annular body by the obturator, the obturator being engaged with the annular seat when the wellbore tool is in the second operating state; and shifting the segmented seat from the upper central bore into the catch bore.

15. The method of claim 14, wherein, after the segmented seat is shifted from the upper central bore into the catch bore, the method further comprises radially expanding the segmented seat within the catch bore; and moving the obturator downwardly through the segmented seat.

16. The method of claim 15, wherein, after the segmented seat is radially expanded within the catch bore and the obturator is moved downwardly through the segmented seat, the method further comprises removing the segmented seat from the wellbore through the use of drilling operations; and restricting rotational movement of the segmented seat during the drilling operations.

17. The method of claim 14, wherein the recess is a chamber in the segmented seat.

18. A segmented seat adapted to be placed in subterranean wellbore equipment and engaged by an obturator, the segmented seat comprising:

an annular body that is radially divided into a plurality of separate segments, the annular body defining a central bore extending axially therethrough, an inner wall extending about the central bore, a generally cylindrical outer wall, and an end wall;

an annular seat formed on the end wall and extending about the central bore of the annular body, the annular seat being of a size and shape to engage the obturator;

at least one recess formed into each of the segments, the respective recesses of the segments forming an endless chamber and defining sidewalls that are offset from the outer wall and the inner wall of the annular body, respectively, such that the chamber extends around the interior of the annular body; and a non-metallic material located in the recess and joining adjacent segments together, the non-metallic material comprising a settable material disposed within the chamber.

19. A segmented seat, comprising:

an annular body comprising a generally cylindrical outer wall, an inner bore extending axially through the annular body, and an annular seat formed on an end wall of the annular body and surrounding the inner bore, the annular seat being of a size and shape to engage an obturator, and the annular body being radially divided into a plurality of separate segments comprising radially-extending adjacent faces;

wherein the plurality of separate segments of the annular body each comprise a recess formed therein, a pair of the radially-extending faces, and a non-metallic material disposed within the recess and joining adjacent ones of the segments together.

20. The segmented seat according to claim 19, wherein the recess is offset from the outer wall of the annular body so that at least a portion of the annular body is located radially between the outer wall and the recess.

21. The segmented seat according to claim 19, wherein the recess comprises a slot.

22. The segmented seat according to claim 21, wherein the slot is endless and extends around the annular body.

23. The segmented seat according to claim 21, wherein the slot is in the end wall.

24. The segmented seat according to claim 19, wherein the recess comprises a chamber formed in the separate segments of the annular body.

25. The segmented seat according to claim 24, wherein the annular body further defines an inner wall and the chamber includes sidewalls that are offset from the inner and outer walls of the annular body such that the chamber extends around the interior of the annular body.

26. The segmented seat according to claim 19, wherein an end wall opposite the end wall containing the annular seat comprises notches.

27. The segmented seat according to claim 19, wherein the non-metallic material comprises elastomer.

28. The segmented seat according to claim 19, wherein the non-metallic material comprises polymer.

29. A downhole wellbore tool, comprising:

an axially-extending passageway configured to be in fluid communication with a tubing string when the tool is connected thereto, the axially-extending passageway comprising a mounting bore having a first diameter, and a catch bore having a larger second diameter; and a segmented seat positioned in the mounting bore of the axially-extending passageway, the segmented seat comprising a generally cylindrical outer wall, an inner bore extending axially through the segmented seat, and an annular seat formed on an end wall of the segmented seat and surrounding the inner bore, the annular seat being of a size and shape to engage an obturator, and the segmented seat being radially divided into a plurality of separate segments comprising radially-extending adjacent faces;

wherein the plurality of separate segments of the segmented seat each comprise a recess formed therein, a pair of the radially-extending faces, and a non-metallic material disposed within the recess and joining adjacent ones of the segments together.

30. The downhole wellbore tool according to claim 29, wherein the recess is offset from the outer wall of the annular body so that at least a portion of the annular body is located radially between the outer wall and the recess.

31. The downhole wellbore tool according to claim 29, additionally comprising a sleeve defining an opening extending axially therethrough;

wherein the segmented seat is mounted within the opening of the sleeve; and wherein, when the obturator is engaged on the annular seat, flow is restricted through the opening in the sleeve and through the internal passage of the annular body.

32. The downhole wellbore tool according to claim 31, wherein the catch bore contains an uphole facing shoulder for engagement with the segmented seat in order to limit and/or restrict rotational movement of the segmented seat.

33. The downhole wellbore tool according to claim 29, wherein the non-metallic material comprises elastomer.

34. The downhole wellbore tool according to claim 29, wherein the non-metallic material comprises polymer.

35. A method of operating a downhole wellbore tool incorporated within a tubing string, the method comprising:

positioning the wellbore tool, via at least the tubing string, at a downhole location within a wellbore that traverses a subterranean formation, the wellbore tool comprising an axially-extending passageway in fluid communication with the tubing string, the axially-extending passageway comprising a mounting bore having a first diameter, and a catch bore having a larger second diameter;

engaging an obturator with a segmented seat positioned in the mounting bore of the axially-extending passageway, the segmented seat comprising a generally cylindrical outer wall, an inner bore extending axially through the segmented seat, and an annular seat formed on an end wall of the segmented seat and surrounding the inner bore, the annular seat being of a size and shape to engage the obturator, and the segmented seat being radially divided into a plurality of separate segments comprising radially-extending adjacent faces;

applying at least a threshold pressure onto the obturator to displace the segmented seat from the mounting bore to the catch bore; and radially expanding the segmented seat within the catch bore so that the obturator is permitted to move downwardly through the inner bore of the segmented seat, the plurality of separate segments of the segmented seat each comprising a recess formed therein, a pair of the radially-extending faces, and a non-metallic material disposed within the recess and joining adjacent ones of the segments together.

36. The method of claim 35, wherein the recess is offset from the outer wall of the annular body so that at least a portion of the annular body is located radially between the outer wall and the recess.

37. The method of claim 35, wherein, after the segmented seat is radially expanded within the catch bore and the obturator is moved downwardly through the segmented seat, the method further comprises: removing the segmented seat from the wellbore through the use of drilling operations; and restricting rotational movement of the segmented seat during the drilling operations.

38. The method of claim 35, wherein the non-metallic material comprises elastomer.

39. The method of claim 35, wherein the non-metallic material comprises polymer.

* * * * *